US010799083B2

(12) United States Patent
Okubo et al.

(10) Patent No.: US 10,799,083 B2
(45) Date of Patent: Oct. 13, 2020

(54) INFORMATION PROCESSING METHOD, INFORMATION PROCESSING APPARATUS, WASHING SYSTEM, AND WASHING APPARATUS

(71) Applicant: Panasonic Intellectual Property Management Co., Ltd., Osaka (JP)

(72) Inventors: Masafumi Okubo, Kyoto (JP); Hiroko Sugimoto, Kyoto (JP); Mariko Nakaso, Shiga (JP); Tomohiko Kitamura, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 28 days.

(21) Appl. No.: 16/058,601

(22) Filed: Aug. 8, 2018

(65) Prior Publication Data

US 2019/0104911 A1 Apr. 11, 2019

(30) Foreign Application Priority Data

Oct. 5, 2017 (JP) ..... 2017-195401
Apr. 13, 2018 (JP) ..... 2018-077641

(51) Int. Cl.
*D06F 33/00* (2020.01)
*A47L 15/00* (2006.01)
(Continued)

(52) U.S. Cl.
CPC ..... *A47L 15/0055* (2013.01); *A47L 15/0028* (2013.01); *A47L 15/449* (2013.01);
(Continued)

(58) Field of Classification Search
CPC .... A47L 15/0055; A47L 15/449; A47L 15/44; A47L 2301/02; A47L 2301/023;
(Continued)

(56) References Cited

U.S. PATENT DOCUMENTS

2010/0071777 A1* 3/2010 Smith ..... D06F 39/022 137/14
2011/0185773 A1* 8/2011 D'Andrea ..... A47L 15/4418 68/17 R
2016/0143503 A1* 5/2016 Kan ..... A47L 15/4418 134/56 D

FOREIGN PATENT DOCUMENTS

JP 2002-153697 5/2002
JP 2002-224489 8/2002
(Continued)

OTHER PUBLICATIONS

Tammy Noergaard, Embedded Systems Architecture—A Comprehensive Guide for Engineers and Programmers (Elsevier 2005) Year: 2005).*

*Primary Examiner* — Douglas Lee
*Assistant Examiner* — Richard Z. Zhang
(74) *Attorney, Agent, or Firm* — Greenblum & Bernstein, P.L.C.

(57) ABSTRACT

An information processing method performed with a processor includes determining whether a second dispensing amount of detergent to be dispensed in a washing apparatus in a scheduled first washing event falls below a threshold based on a remaining amount of the detergent in a detergent container of the washing apparatus and a first dispensing amount set for one washing event for washing a washing target, changing a third dispensing amount determined based on the first dispensing amount to be dispensed into the washing apparatus in a second washing event preceding the first washing event to a fourth dispensing amount equaling or exceeding the threshold when the second dispensing amount is determined to fall below the threshold, outputting information representing the fourth dispensing amount, and causing the washing apparatus to dispense the fourth dis-
(Continued)

pensing amount of the detergent in the second washing event.

10 Claims, 16 Drawing Sheets

(51) Int. Cl.
*A47L 15/44* (2006.01)
*D06F 39/02* (2006.01)

(52) U.S. Cl.
CPC ..... *D06F 33/00* (2013.01); *A47L 2301/08* (2013.01); *A47L 2401/023* (2013.01); *D06F 39/02* (2013.01); *D06F 2202/10* (2013.01); *D06F 2202/12* (2013.01); *D06F 2204/02* (2013.01); *D06F 2212/02* (2013.01); *D06F 2214/00* (2013.01)

(58) Field of Classification Search
CPC ... A47L 2401/023; D06F 33/02; D06F 39/02; D06F 39/08; D06F 2202/02; D06F 2204/02; D06F 2204/08; D06F 39/022
See application file for complete search history.

(56) References Cited

FOREIGN PATENT DOCUMENTS

| | | |
|---|---|---|
| JP | 2010-136794 | 6/2010 |
| JP | 2016-067810 | 5/2016 |

* cited by examiner

INFORMATION PROCESSING METHOD, INFORMATION PROCESSING APPARATUS, WASHING SYSTEM, AND WASHING APPARATUS

BACKGROUND

1. Technical Field

The present disclosure relates to an information processing method, an information processing apparatus, a washing system, and a washing apparatus relating to washing a washing target.

2. Description of the Related Art

Various washing apparatuses, such as a washing machine or a dishwasher, have been developed. Some of these washing apparatuses have a mechanism that automatically dispenses detergent for washing a washing target, such as clothes or dishes (see Japanese Unexamined Patent Application Publication Nos. 2002-224489, 2016-67810, 2002-153697, and 2010-136794).

Unlike traditional washing apparatuses into which a user dispenses detergent in each washing cycle, the washing apparatuses disclosed in these publications automatically dispense detergent, and thus are capable of reducing a work burden on the user for dispensing detergent. That is, if the user stores the detergent in a detergent storing unit included in the washing apparatuses, the detergent is automatically dispensed into a washing space in which the washing target is washed. Therefore, the user does not have to measure the amount of detergent and dispense the measured amount of detergent into the washing space in each washing cycle.

SUMMARY

The detergent stored in the detergent storing unit may be solidified or increased in viscosity by lapse of time. The detergent solidified or increased in viscosity may clog a passage leading to the washing space. That is, the detergent stored in the detergent storing unit for an extended period of time increases the risk of malfunction of the washing apparatus. The detergent storing unit is therefore desired to be washed.

It is preferable that the detergent storing unit be washed when empty (or determined to be empty). If there is detergent in the detergent storing unit, the detergent therein would be discarded by washing the detergent storing unit.

If the detergent in the detergent storing unit is reduced, the user may dispense more detergent, by which the time to wash the detergent storing unit would be missed.

The washing apparatuses disclosed in the foregoing publications determine an appropriate dispensing amount of the detergent by referring to the amount of the washing target or the remaining amount of the detergent. The techniques disclosed in these publications, however, do not necessarily empty the detergent storing unit, and thus are unable to prompt washing of the detergent storing unit. If the detergent storing unit is not washed, the risk of solidification or increase in viscosity of the detergent in the detergent storing unit is increased. The detergent solidified or increased in viscosity increases the risk of malfunction of the washing apparatuses, as described above.

One non-limiting and exemplary embodiment provides a technique of creating an opportunity to wash the detergent storing unit, to thereby reduce the risk of malfunction of a washing apparatus.

In one general aspect, the techniques disclosed here feature an information processing method performed with a processor and including: acquiring, from a washing apparatus, remaining amount information representing a remaining amount of detergent in a detergent container included in the washing apparatus to store the detergent; determining whether a second dispensing amount of the detergent falls below a predetermined threshold based on the remaining amount information and a first dispensing amount, the first dispensing amount being set for one washing event in which the washing apparatus washes a washing target, and the second dispensing amount being an amount of the detergent scheduled to be dispensed into the washing apparatus in a scheduled first washing event; changing a third dispensing amount to a fourth dispensing amount when the second dispensing amount is determined to fall below the predetermined threshold, the third dispensing amount being an amount of the detergent determined based on the first dispensing amount and scheduled to be dispensed into the washing apparatus in at least one second washing event scheduled to precede the first washing event, and the fourth dispensing amount being equal to or greater than the predetermined threshold; and outputting information representing the fourth dispensing amount to the washing apparatus to dispense the fourth dispensing amount of the detergent into the washing apparatus in the at least one second washing event.

The general aspect may be implemented using a computer program, and any combination of systems, methods, and computer programs.

The above-described technique is capable of creating an opportunity to wash the detergent container, to thereby reduce the risk of malfunction of the washing apparatus.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

First Embodiment

When a user supplies detergent to a detergent storing unit of a washing apparatus, the detergent storing unit is filled with a large amount of detergent. If the washing apparatus is thereafter used repeatedly, the detergent in the detergent storing unit gradually decreases. If the detergent storing unit is eventually emptied and washed, solidification or increase in viscosity of the detergent is unlikely to occur. That is, the risk of the detergent solidified or increased in viscosity causing clogging in the washing apparatus is reduced. If the user thereafter supplies additional detergent to the detergent storing unit, the washing apparatus is able to operate reliably. If the detergent storing unit is emptied during the period from the supply of the detergent to the detergent storing unit to the next supply of the detergent, there is a preferable time for washing the detergent storing unit with little waste of the detergent. In a first embodiment, a description will be given of an exemplary washing system that empties the detergent storing unit.

Figure 1:
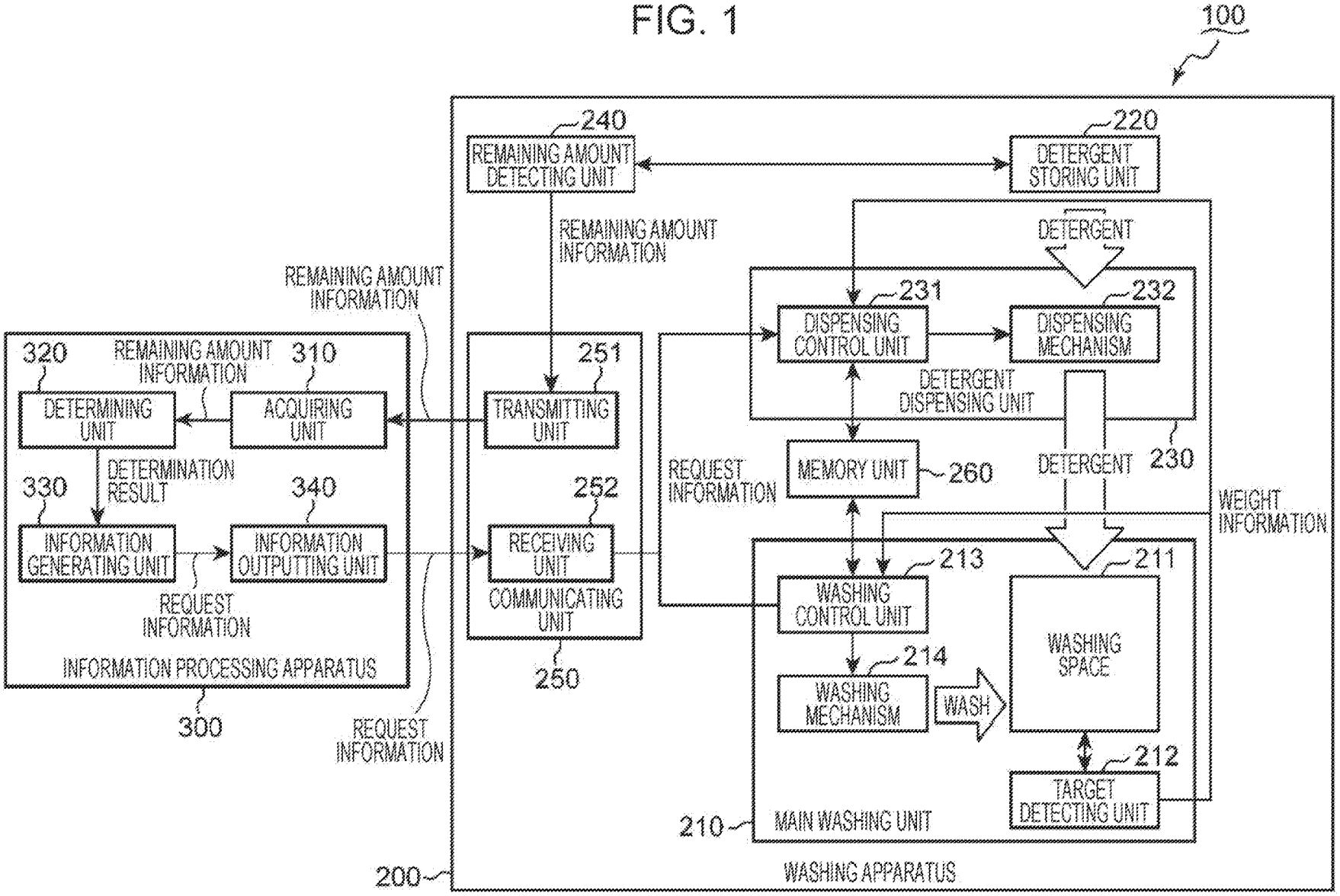
FIG. 1 is a schematic block diagram illustrating an exemplary functional configuration of a washing system of a first embodiment.

FIG. 1 is a schematic block diagram illustrating an exemplary functional configuration of a washing system 100 of the first embodiment. The washing system 100 will be described with reference to FIG. 1.

The washing system 100 includes a washing apparatus 200 and an information processing apparatus 300. The washing apparatus 200 may be a washing machine that washes clothes placed therein as a washing target, or may be a dishwasher that washes dishes placed therein as a washing target. The principle of the present embodiment is not limited to a specific function of the washing apparatus 200.

The washing apparatus 200 is formed to be communicable with the information processing apparatus 300. The principle of the present embodiment is not limited to a specific format of communication between the washing apparatus 200 and the information processing apparatus 300. For example, Wi-Fi communication may be used as the communication between the washing apparatus 200 and the information processing apparatus 300.

The information processing apparatus 300 processes information relating to the amount of detergent used to wash the washing target. The information processing apparatus 300 may be a communication terminal, such as a smartphone, a tablet terminal, or a mobile phone. Alternatively, the information processing apparatus 300 may be a cloud server. The principle of the present embodiment is not limited to a specific communication apparatus used as the information processing apparatus 300.

The washing apparatus 200 includes a main washing unit 210, a detergent storing unit 220, a detergent dispensing unit 230, a remaining amount detecting unit 240, a communicating unit 250, and a memory unit 260. The main washing unit 210 is formed with a washing space 211 in which the washing target such as clothes or dishes is placed. The washing target is washed in the washing space 211.

The main washing unit 210 includes a target detecting unit 212, a washing control unit 213, and a washing mechanism 214. The target detecting unit 212 detects the weight of the washing target placed in the washing space 211, and generates weight information representing the detected weight. The weight information is output to the washing control unit 213 and the detergent dispensing unit 230 from the target detecting unit 212. The washing control unit 213 refers to the weight information, and determines details of washing (the length of a washing period, for example). The detergent dispensing unit 230 refers to the weight information, and determines the amount of detergent to be dispensed into the washing space 211. Accordingly, the washing target is washed with an appropriate amount of detergent for the weight of the washing target in the washing space 211.

The washing mechanism 214 washes the washing target in the washing space 211 under the control of the washing control unit 213. A washing structure employed in a known washing machine or dishwasher is applicable to the washing mechanism 214. The washing mechanism 214 may include valve elements for opening and closing a water supply passage to the washing space 211 and a water drainage passage from the washing space 211. If the washing apparatus 200 is a washing machine, the washing mechanism 214 may include a motor that rotates a washing tub that forms the washing space 211 in which the clothes are placed. If the washing apparatus 200 is a dishwasher, the washing mechanism 214 may include a motor that moves a nozzle for spraying water. The principle of the present embodiment is not limited to a specific structure of the washing mechanism 214.

Control information necessary for controlling the washing mechanism 214 (the amount of water to be supplied or the length of the washing period corresponding to the weight of the washing target detected by the target detecting unit 212, for example) is stored in the memory unit 260. The washing control unit 213 reads the control information from the memory unit 260, and controls the washing mechanism 214 based on the weight information and the control information. Consequently, the washing mechanism 214 is capable of appropriately washing the washing target in the washing space 211 under the control of the washing control unit 213.

The detergent is stored in the detergent storing unit 220. The detergent may be liquid (a film-coated liquid block), solid such as powder, or gel. The principle of the present embodiment is not limited to a specific type of detergent used to wash the washing target.

The detergent dispensing unit 230 includes an dispensing control unit 231 and a dispensing mechanism 232. The aforementioned weight information is output to the dispensing control unit 231 from the target detecting unit 212. As well as the aforementioned control information, detergent amount information, which represents the relationship between the weight of the washing target in the washing space 211 and the dispensing amount of the detergent to be dispensed into the washing space 211, is also stored in the memory unit 260. Having received the weight information from the target detecting unit 212, the dispensing control unit 231 reads the detergent amount information from the memory unit 260, and finds a detergent dispensing amount corresponding to the weight of the washing target represented by the weight information. The dispensing control unit 231 controls the dispensing mechanism 232 such that the dispensing mechanism 232 dispenses the detergent into the washing space 211 from the detergent storing unit 220 by the found detergent dispensing amount. Consequently, the dispensing mechanism 232 is capable of dispensing the detergent into the washing space 211 from the detergent storing unit 220 by an appropriate amount for the weight of the washing target in the washing space 211 under the control of the dispensing control unit 231. The dispensing mechanism 232 may be a valve element that opens or closes a passage for supplying liquid detergent. Alternatively, the dispensing mechanism 232 may be a combination of a screw feeder that transports powdery detergent and a motor that drives the screw feeder. The principle of the present embodiment is not limited to a specific structure of the dispensing mechanism 232.

The remaining amount detecting unit 240 detects the remaining amount of the detergent in the detergent storing unit 220. The remaining amount detecting unit 240 generates remaining amount information representing the detected remaining amount. The remaining amount information is output to the communicating unit 250 from the remaining amount detecting unit 240. The remaining amount detecting unit 240 may be a common optical sensor that optically detects the remaining amount of the detergent in the detergent storing unit 220, or may be a common weight sensor that detects the weight of the detergent in the detergent storing unit 220. The principle of the present embodiment is not limited to a specific sensor device employed as the remaining amount detecting unit 240.

The communicating unit 250 includes a transmitting unit 251 and a receiving unit 252. The transmitting unit 251 receives the above-described remaining amount information from the remaining amount detecting unit 240. The transmitting unit 251 transmits the remaining amount information to the information processing apparatus 300. The information processing apparatus 300 refers to the remaining amount information, and determines whether there will be shortage of the detergent to be dispensed into the washing space 211 in a subsequent washing event. The term "washing event" refers to the period from the placement of the washing target into the washing space 211 by the user to the completion of washing of the washing target or an operation of the washing apparatus 200 and/or the information processing apparatus 300 performed during this period.

Before or after a washing event in which the shortage of detergent is expected, the information processing apparatus 300 generates request information for requesting the washing apparatus 200 to perform an operation of emptying the detergent storing unit 220. The receiving unit 252 receives the request information from the information processing apparatus 300. Thereafter, the request information is output to the washing control unit 213 and the dispensing control unit 231 from the receiving unit 252. The dispensing control unit 231 adjusts the amount of detergent to be dispensed into the washing space 211 in accordance with the request information. The washing control unit 213 controls the washing operation of the washing mechanism 214 to suit the adjusted detergent dispensing amount.

The information processing apparatus 300 includes an acquiring unit 310, a determining unit 320, an information generating unit 330, and an information outputting unit 340. The acquiring unit 310 receives the remaining amount information transmitted from the communicating unit 250. The remaining amount information is thereafter output to the determining unit 320 from the acquiring unit 310. The determining unit 320 refers to the remaining amount information, and determines whether there will be shortage of the detergent to be dispensed into the washing space 211 in a subsequent washing event. If the determining unit 320 determines that there will be shortage of the detergent dispensing amount, a determination result representing the shortage of the detergent dispensing amount is output to the information generating unit 330 from the determining unit 320. The information generating unit 330 refers to the determination result, and generates the request information for requesting the operation for emptying the detergent storing unit 220. The request information is transmitted to the information outputting unit 340 from the information generating unit 330. The information outputting unit 340 transmits the request information to the communicating unit 250.

Figure 2:
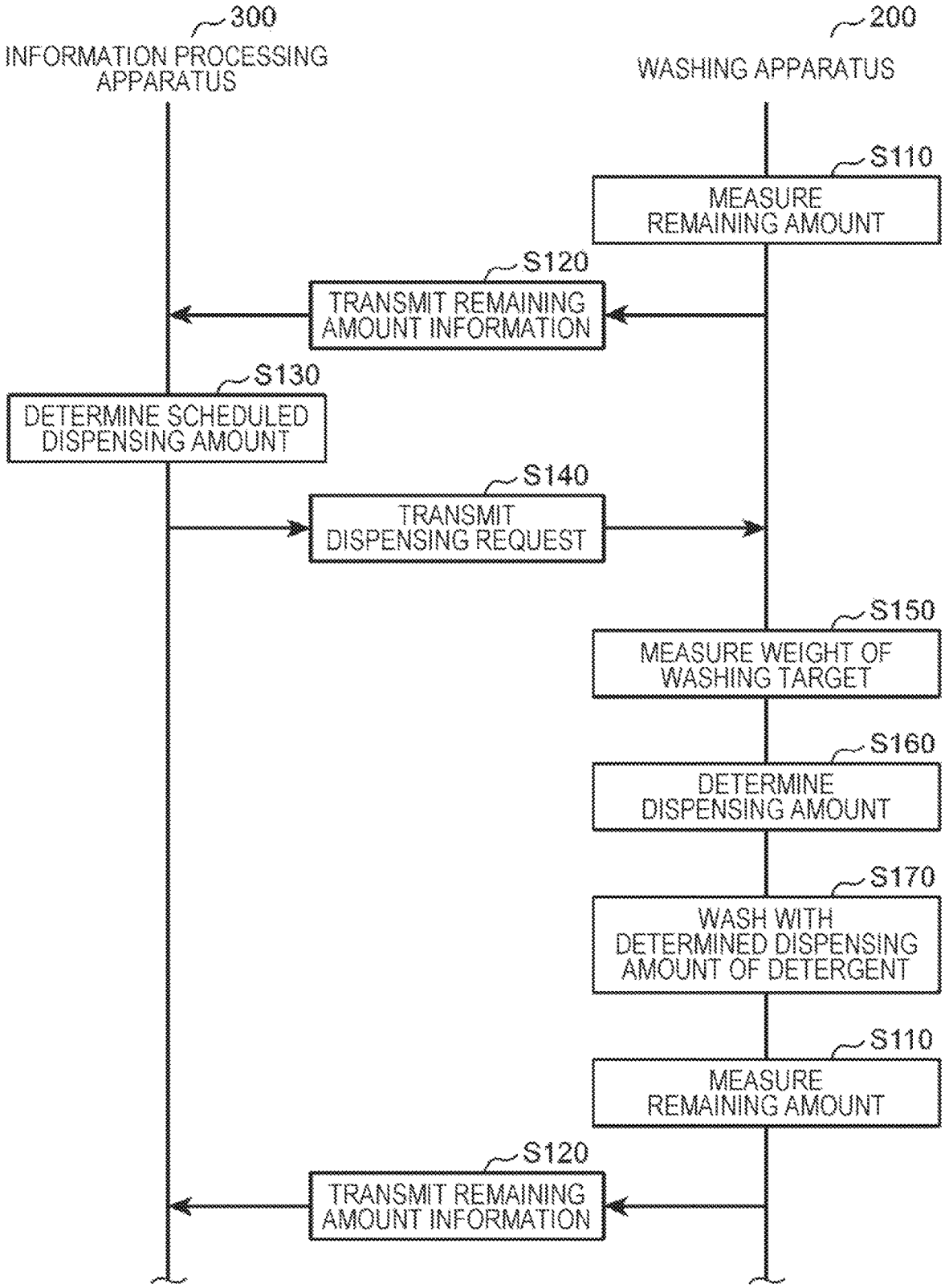
FIG. 2 is a sequence chart illustrating an overview of an exemplary operation of the washing system illustrated in FIG. 1.

FIG. 2 is a sequence chart illustrating an overview of a process of the washing system 100. The overview of the process of the washing system 100 will be described with reference to FIGS. 1 and 2.

(Step S110)

The washing apparatus 200 measures the remaining amount of the detergent. Specifically, the remaining amount detecting unit 240 detects the amount of the detergent remaining in the detergent storing unit 220, and generates the remaining amount information. Thereafter, step S120 is executed.

(Step S120)

The washing apparatus 200 outputs the remaining amount information to the information processing apparatus 300. Specifically, the remaining amount information is output to the transmitting unit 251 from the remaining amount detecting unit 240. The transmitting unit 251 generates a radio signal representing the remaining amount information. The radio signal is output to the acquiring unit 310 from the transmitting unit 251. Thereafter, step S130 is executed.

(Step S130)

The information processing apparatus 300 determines a scheduled dispensing amount. Specifically, the acquiring unit 310 converts the radio signal into an electrical signal, and outputs the remaining amount information to the determining unit 320 as the electrical signal. Based on the remaining amount information, the determining unit 320 determines the dispensing amount of the detergent to be dispensed in the next washing event (that is, the scheduled dispensing amount). Thereafter, step S140 is executed.

(Step S140)

The information processing apparatus 300 outputs a dispensing request to the washing apparatus 200. Specifically, the determination result representing the determined scheduled dispensing amount is output to the information generating unit 330 from the determining unit 320. The information generating unit 330 generates, as the request information, the dispensing request for requesting the determined scheduled dispensing amount of detergent to be dispensed in the next washing event. The dispensing request is output to the information outputting unit 340 from the information generating unit 330. The information outputting unit 340 transmits the dispensing request to the washing apparatus 200 as a radio signal. Thereafter, step S150 is executed.

(Step S150)

When the user places the washing target in the washing space 211, the washing apparatus 200 measures the weight of the washing target. Specifically, the target detecting unit 212 measures the weight of the washing target, and generates the weight information. The weight information is output to the dispensing control unit 231 from the target detecting unit 212. Thereafter, step S160 is executed.

(Step S160)

The washing apparatus 200 determines the dispensing amount of the detergent. Specifically, the dispensing control unit 231 receives the weight information from the target detecting unit 212, and receives the dispensing request from the information outputting unit 340 via the receiving unit 252. Based on the weight information and the dispensing request, the dispensing control unit 231 determines the dispensing amount of detergent to be actually supplied to the washing space 211. Thereafter, step S170 is executed.

(Step S170)

The washing apparatus 200 dispenses the determined dispensing amount of detergent into the washing space 211. Specifically, under the control of the dispensing control unit 231, the dispensing mechanism 232 dispenses the determined dispensing amount of detergent into the washing space 211 from the detergent storing unit 220. Under the control of the washing control unit 213, the washing mechanism 214 washes the washing target in the washing space 211. Thereafter, step S110 is executed again.

Figure 3:
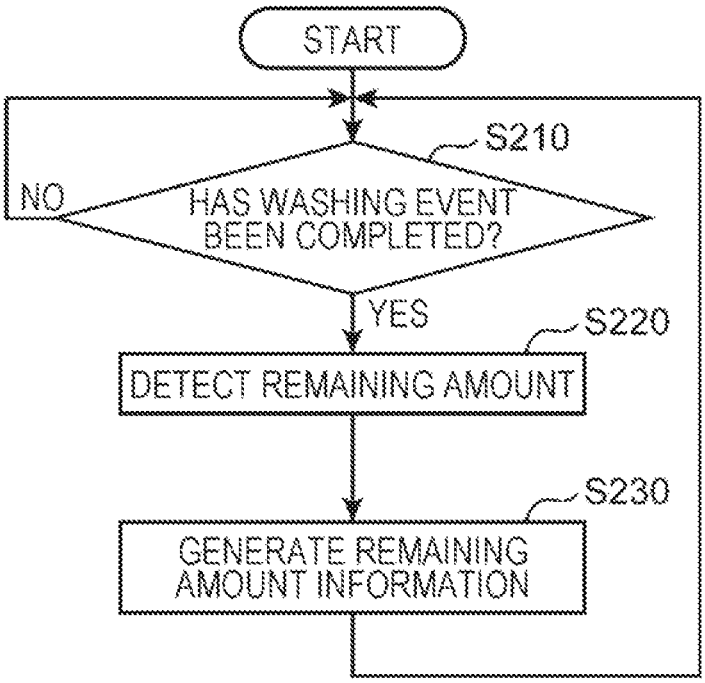
FIG. 3 is a schematic flowchart illustrating an exemplary operation of a remaining amount detecting unit of the washing system illustrated in FIG. 1.

FIG. 3 is a schematic flowchart illustrating an exemplary operation of the remaining amount detecting unit 240. The operation of the remaining amount detecting unit 240 will be described with reference to FIGS. 1 and 3.

(Step S210)

The remaining amount detecting unit 240 waits for the completion of the washing event. The remaining amount detecting unit 240 may be notified by the washing control unit 213 of the completion of the washing event, or may detect the completion of the washing event from another condition. The principle of the present embodiment is not limited at all by how the remaining amount detecting unit 240 detects the completion of the washing event. After the completion of the washing event, step S220 is executed.

(Step S220)

The remaining amount detecting unit 240 detects the amount of the detergent remaining in the detergent storing unit 220. Thereafter, step S230 is executed.

(Step S230)

The remaining amount detecting unit 240 generates the remaining amount information representing the detected remaining amount. The remaining amount information is thereafter transmitted to the determining unit 320 via the transmitting unit 251 and the acquiring unit 310. After the generation of the remaining amount information, the process returns to step S210.

Figure 4:
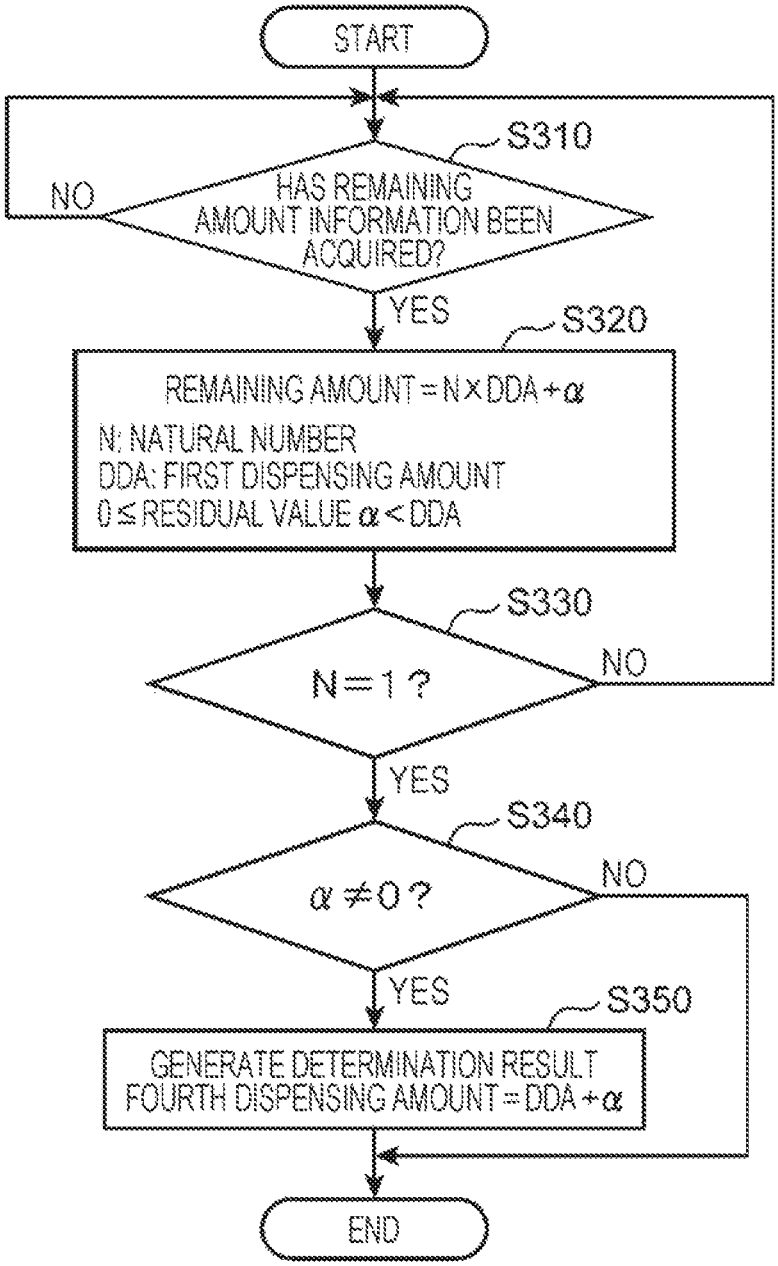
FIG. 4 is a schematic flowchart illustrating an exemplary operation of a determining unit of the washing system illustrated in FIG. 1.

FIG. 4 is a schematic flowchart illustrating an exemplary operation of the determining unit 320. The operation of the determining unit 320 will be described with reference to FIGS. 1 to 4.

(Step S310)

The determining unit 320 waits for the remaining amount information. After step S230 described with reference to FIG. 3 is executed, the determining unit 320 is able to acquire the remaining amount information via the transmitting unit 251 and the acquiring unit 310. After the determining unit 320 acquires the remaining amount information, step S320 is executed.

(Step S320)

The determining unit 320 determines whether to change the dispensing amount based on the remaining amount information and a set dispensing amount, which is previously set (a set dispensing amount set for one washing event, which will hereinafter be referred to as the first dispensing amount). Specifically, the determining unit 320 calculates a number N of washing events executable with the set dispensing amount and a residual value a of the detergent in the (N+1)-th washing event from the remaining amount represented by the remaining amount information and the set dispensing amount, and determines whether the value resulting from the calculation falls below a threshold. In other words, the remaining amount represented by the remaining amount information is expressible by a formula described in the block of step S320. The first dispensing amount may have a value suitable for washing an average weight of washing target placed in the washing space 211. Alternatively, the first dispensing amount may be determined based on detergent usage history information. The principle of the present embodiment is not limited at all by how the first dispensing amount is set.

The determining unit 320 calculates the natural number "N" and the residual value "α" from the remaining amount represented by the remaining amount information and the first dispensing amount. The natural number "N" is used as an indicator of how many washing events are executable with the current remaining amount. The residual value "α" is equal to or greater than "0," and is less than the first dispensing amount. The residual value "α" represents a second dispensing amount of detergent scheduled to be dispensed in the last washing event to be executed with the current remaining amount. After the determining unit 320 calculates the natural number "N" and the residual value "α," step S330 is executed. As for the present embodiment, the first dispensing amount is illustrative of the predetermined threshold. However, the predetermined threshold may be a value less than the first dispensing amount. In the present embodiment, the dispensing amount of detergent scheduled to be dispensed in each of washing events up to the N-th washing event (a third dispensing amount) corresponds to the first dispensing amount. However, the dispensing amount in each of the washing events up to the N-th washing event may be increased or reduced if the increase or reduction in the dispensing amount does not change the total dispensing amount for the washing events up to the N-th washing event.

(Step S330)

If the natural number "N" is "1," step S340 is executed. Otherwise, step S310 is executed.

(Step S340)

The determining unit 320 determines whether the residual value "α" equals "0." If the residual value "α" equals "0," the process is completed. Otherwise, step S350 is executed.

(Step S350)

The determining unit 320 generates a determination result representing the scheduled dispensing amount of detergent to be dispensed in the next washing event (hereinafter referred to as the "fourth dispensing amount"). The determination result may include information indicating that the fourth dispensing amount is the sum of the third dispensing amount and the residual value "α." The determination result is output to the information generating unit 330 from the determining unit 320. The information generating unit 330 generates, as the request information, a dispensing request for requesting an amount of detergent corresponding to the sum of the third dispensing amount and the residual value "α" to be dispensed. The request information is transmitted to the information outputting unit 340. Thereafter, the request information is transmitted to the receiving unit 252 from the information outputting unit 340. The dispensing control unit 231 is capable of receiving the request information via the receiving unit 252. When the dispensing control unit 231 receives the request information, the amount of the detergent remaining in the detergent storing unit 220 is substantially equal to the sum of the third dispensing amount and the residual value "α." Therefore, when the dispensing control unit 231 instructs the dispensing mechanism 232 to dispense the amount of detergent corresponding to the sum of the third dispensing amount and the residual value "α" in accordance with the request information and the dispensing mechanism 232 dispenses the detergent into the washing space 211 from the detergent storing unit 220 under the control of the dispensing control unit 231, the detergent storing unit 220 is substantially emptied. After the determining unit 320 generates the determination result, the determining unit 320 completes the determination process.

Figure 5:
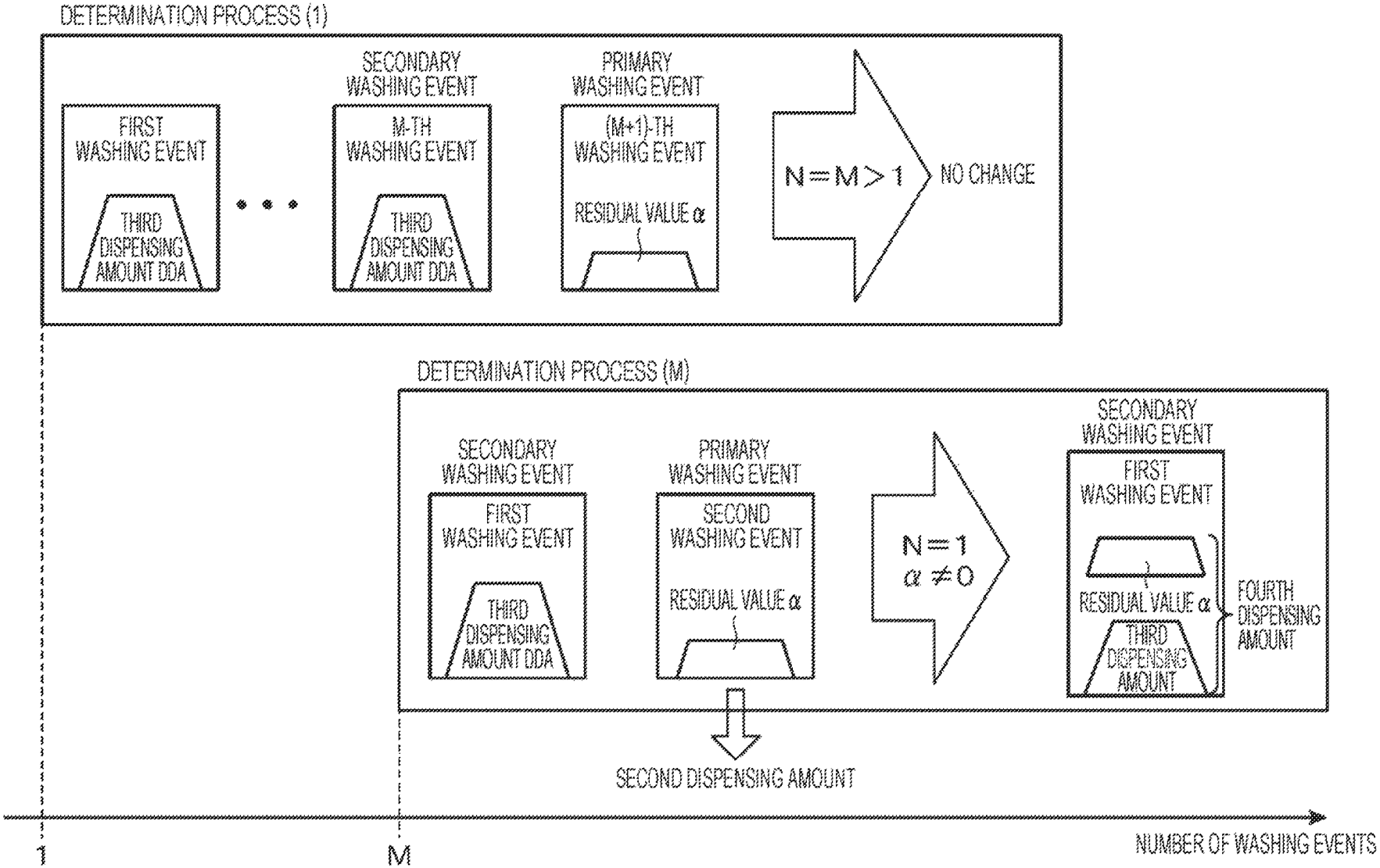
FIG. 5 is a conceptual diagram of a determination process of the determining unit.

FIG. 5 is a conceptual diagram of the determination process of the determining unit 320. The determination process will be further described with reference to FIGS. 1 to 5.

DETERMINATION PROCESS (1) in FIG. 5 represents the process of the determining unit 320 having acquired first remaining amount information (that is, the remaining amount information generated at step S230 in FIG. 3). The determining unit 320 has determined that an amount of detergent enabling up to M (wherein M>1) washing events to be executed with the third dispensing amount, that is, the first dispensing amount "DDA," remains in the detergent storing unit 220. Since "N=M (wherein M>1)" holds (NO at step S330), the determining unit 320 does not generate the determination result that changes the scheduled dispensing amount. That is, the scheduled dispensing amount for the first washing event (the second dispensing amount) remains to be the first dispensing amount "DDA."

DETERMINATION PROCESS (M) in FIG. 5 represents the process of the determining unit 320 performed when the natural number "N" equals "1" after a process loop of steps S310 to S330 in FIG. 4 is repeated (that is, when the M-th washing event arises). The determining unit 320 determines that an amount of detergent enabling up to one washing event to be executed with the third dispensing amount, that is, the first dispensing amount "DDA," remains in the detergent storing unit 220. Since "N=(M−(M−1))=1" holds here (YES at step S330), the determining unit 320 compares the residual value "α" with a threshold "RTH."

A step S340, the determining unit 320 checks whether the residual value a1 "α" equals "0." If the residual value "α" equals "0," the detergent storing unit 220 will be substantially emptied even without the process at step S350 of adjusting the dispensing amount. If the residual value "α" does not equal "0," there arises a second washing event (first washing event) which involves shortage of the scheduled dispensing amount of detergent. In this case, the determining unit 320 determines the amount corresponding to the sum of the third dispensing amount, that is, the first dispensing amount "DDA," and the residual value "α" as the fourth dispensing amount in a first washing event (second washing event) preceding the second washing event being the first washing event, as illustrated in DETERMINATION PROCESS (M) in FIG. 5.

Figure 6:
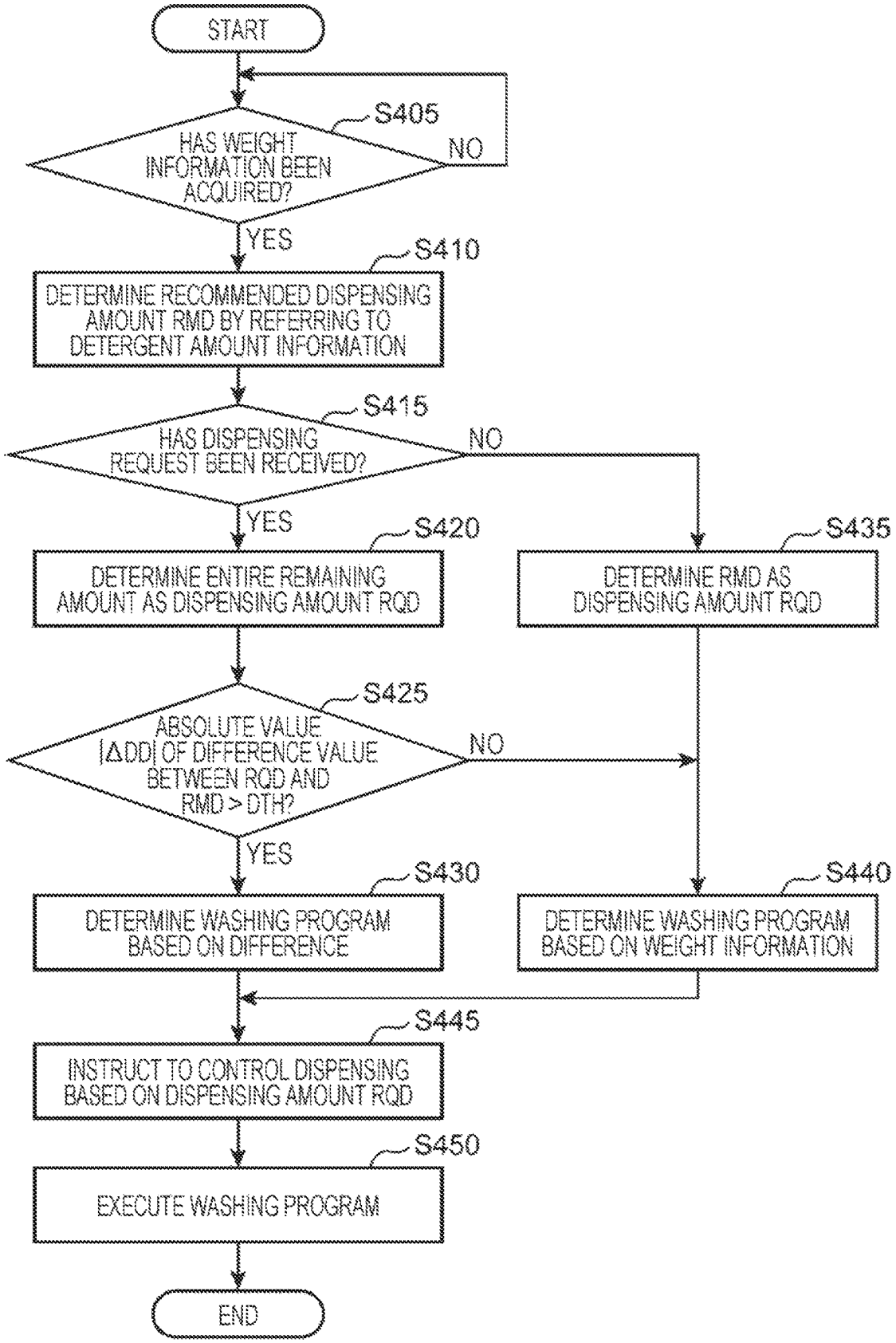
FIG. 6 is a schematic flowchart illustrating an exemplary operation of a dispensing control unit and a washing control unit of the washing system illustrated in FIG. 1.

FIG. 6 is a schematic flowchart illustrating an exemplary operation of the dispensing control unit 231 and the washing control unit 213. The operation of the dispensing control unit 231 and the washing control unit 213 will be described with reference to FIG. 1 and FIGS. 4 to 6.

(Step S405)

The dispensing control unit 231 and the washing control unit 213 wait for the weight information. After the dispensing control unit 231 receives the weight information from the target detecting unit 212, step S410 is executed.

(Step S410)

The washing control unit 213 reads the detergent amount information (see "TABLE 1" given below) from the memory unit 260. Thereafter, step S415 is executed.

TABLE 1

| Detergent amount information | |
|---|---|
| Weight of washing target | Recommended dispensing amount of detergent |
| Less than $TW_0$ | $DD_0$ |
| Equal to or greater than $TW_0$ and less than $TW_1$ | $DD_1$ |
| Equal to or greater than $TW_1$ and less than $TW_2$ | $DD_2$ |
| . | . |
| . | . |
| . | . |
| Equal to or greater than $TW_{n-1}$ and equal to or less than $TW_n$ | $DD_n$ |

(Step S415)

The dispensing control unit 231 and the washing control unit 213 check whether the request information has been received. If the dispensing control unit 231 and the washing control unit 213 have received the request information via the receiving unit 252 (that is, if step S350 in FIG. 4 has been executed), step S420 is executed. Otherwise, step S435 is executed.

(Step S420)

The dispensing control unit 231 determines the amount of all detergent remaining in the detergent storing unit 220 as a dispensing amount "RQD." Thereafter, step S425 is executed.

(Step S425)

The dispensing control unit 231 subtracts a recommended dispensing amount "RMD" determined at step S410 from the dispensing amount "RQD" determined at step S420, to thereby calculate a difference value "ΔDD." The dispensing control unit 231 compares the absolute value of the difference value "ΔDD" with a predetermined threshold "DTH." If the absolute value of the difference value "ΔDD" is greater than the threshold "DTH," step S430 is executed. Otherwise, step S440 is executed.

(Step S430)

The washing control unit 213 refers to a program list stored in the memory unit 260, and finds a washing program corresponding to the weight represented by the weight information. A table given below conceptually represents the program list. If the weight represented by the weight information is in the range of "equal to or greater than $TW_1$ and less than $TW_2$," the washing control unit 213 selects "Program 2" as the washing program to be adjusted.

TABLE 2

| Program list | |
|---|---|
| Weight of washing target | Washing program |
| Less than $TW_0$ | Program 0 |
| Equal to or greater than $TW_0$ and less than $TW_1$ | Program 1 |
| Equal to or greater than $TW_1$ and less than $TW_2$ | Program 2 |
| . | . |
| . | . |
| . | . |
| Equal to or greater than $TW_{n-1}$ and equal to or less than $TW_n$ | Program n |

The washing control unit 213 changes the selected washing program in accordance with the difference value "ΔDD." A positive difference value "ΔDD" indicates that the detergent dispensing amount is greater than the recommended dispensing amount "RMD." Therefore, the washing control unit 213 may change a set value of the selected washing program to extend a rinsing time. A negative difference value "ΔDD" indicates that the detergent dispensing amount is less than the recommended dispensing amount "RMD." Therefore, the washing control unit 213 may change a set value of the selected washing program to shorten the rinsing time. In addition to or in place of the adjustment of the rinsing time, the washing control unit 213 may change a set value of the selected washing program to adjust the amount of water to be supplied to the washing space 211, a washing time, or the number of rinsing cycles in accordance with the difference value "ΔDD." The principle of the present embodiment is not limited to a specific control parameter adjusted by the washing control unit 213. After the selected washing program is adjusted, step S445 is executed.

(Step S435)

The washing control unit 213 refers to the detergent amount information, and determines the recommended dispensing amount "RMD" corresponding to the weight represented by the weight information. If the weight represented by the weight information is in the range of "equal to or greater than $TW_1$ and less than $TW_2$," the washing control unit 213 recognizes a value "$DD_2$" as the recommended dispensing amount "RMD." After the washing control unit 213 determines the recommended dispensing amount "RMD," step S440 is executed.

(Step S440)

The washing control unit 213 refers to the program list stored in the memory unit 260, and finds a washing program corresponding to the weight represented by the weight information. If the weight represented by the weight information is in the range of "equal to or greater than $TW_1$ and less than $TW_2$," the washing control unit 213 selects "Program 2" as the washing program to be adjusted. After the selection of the washing program, step S445 is executed.

(Step S445)

The dispensing control unit 231 generates a dispensing control signal for instructing to dispense the detergent by the dispensing amount "RQD" determined at step S420 or S435. The dispensing control signal is output to the dispensing mechanism 232 from the dispensing control unit 231. The dispensing mechanism 232 dispenses the detergent into the washing space 211 by the dispensing amount "RQD" determined at step S420 or S435. The dispensing mechanism 232 may know the dispensing amount "RQD" of the detergent dispensed into the washing space 211 through feedback control with the remaining amount detecting unit 240 or by reference to a sensor device (not illustrated) included in the dispensing mechanism 232.

(Step S450)

The washing control unit 213 executes the washing program, and controls the washing mechanism 214. Accordingly, the washing target in the washing space 211 is appropriately washed.

(Other Features)

The above-described control technique may be provided with various features by a designer. Features described below do not limit the above-described control principle at all.

(Method of Determining First Dispensing Amount Based on User Usage History)

The first dispensing amount "DDA" described with reference to FIG. 4 may be determined based on user usage history. A method of determining the first dispensing amount "DDA" based on the user usage history will be described below. The third dispensing amount may be determined based on the previously set first dispensing amount and the user usage history.

Step S320 described with reference to FIG. 4 is repeated until the natural number "N" equals "1." The first dispensing amount "DDA" may be set during this repeating process.

Figure 7:
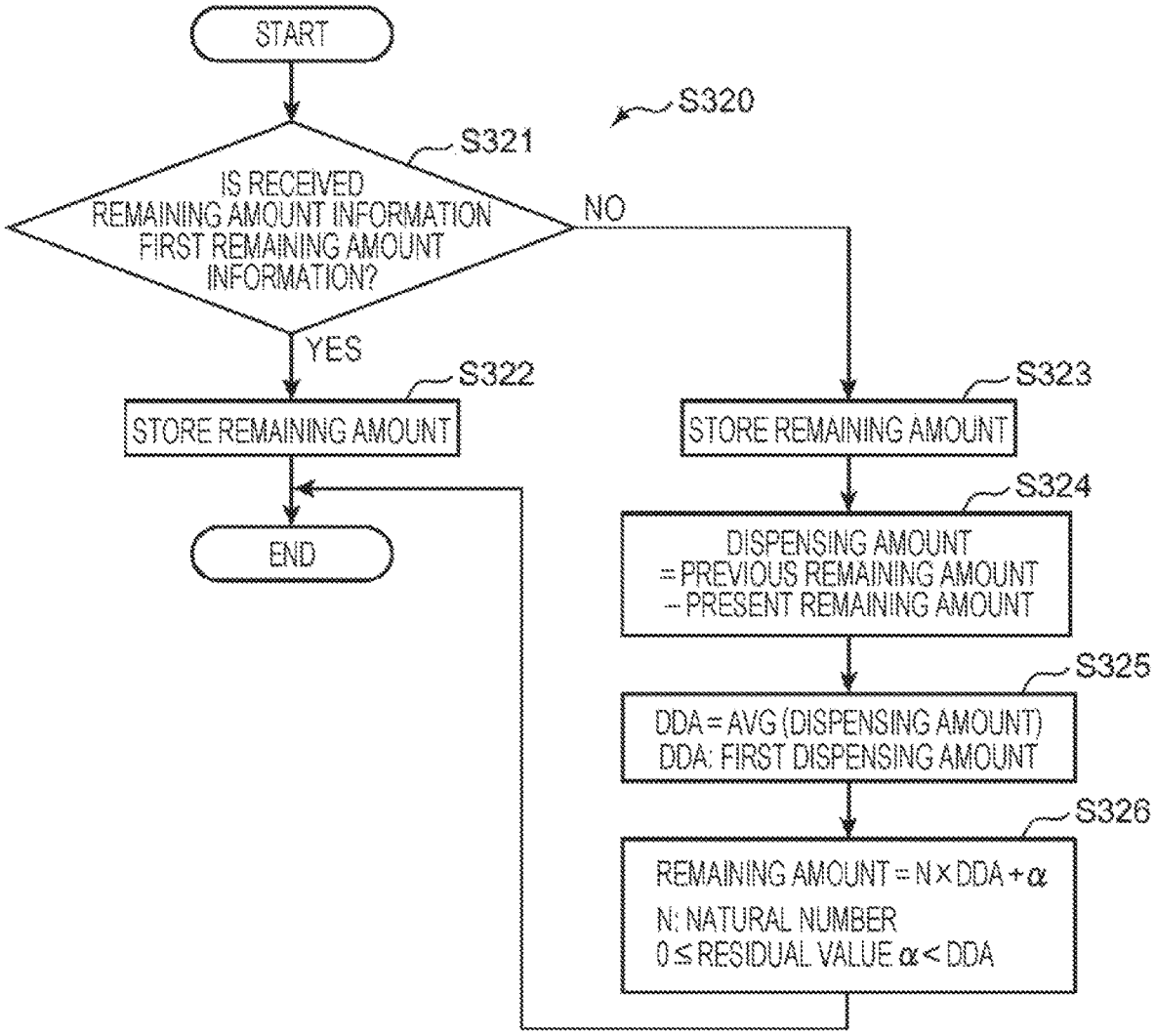
FIG. 7 is a schematic flowchart illustrating an exemplary process for setting a first dispensing amount.

FIG. 7 is a schematic flowchart illustrating an exemplary process for setting the first dispensing amount "DDA." The process for setting the first dispensing amount "DDA" will be described with reference to FIGS. 1, 4, and 7.

(Step S321)

The determining unit 320 determines whether the remaining amount information received from the acquiring unit 310 is the first remaining amount information. The determining unit 320 may refer to a process flag for this determination. When the washing system 100 is first used, or when step S350 in FIG. 4 is executed, the process flag may be turned on. If the process flag is on, the determining unit 320 is capable of determining that the remaining amount information received from the acquiring unit 310 is the first remaining amount information. If having determined that the remaining amount information received from the acquiring unit 310 is the first remaining amount information, the determining unit 320 turns off the process flag. Thereafter, step S322 is executed. If the process flag is not on when step S321 starts, step S323 is executed.

(Step S322)

The determining unit 320 stores the remaining amount represented by the first remaining amount information. Thereafter, the process is completed.

(Step S323)

The determining unit 320 stores the remaining amount represented by the remaining amount information received from the acquiring unit 310. Thereafter, step S324 is executed.

(Step S324)

The determining unit 320 subtracts the present remaining amount from the previous remaining amount to calculate the detergent dispensing amount for the present washing event, and stores the calculated detergent dispensing amount. Thereafter, step S325 is executed.

(Step S325)

The determining unit 320 averages the detergent dispensing amounts stored thus far, and updates the first dispensing amount "DDA." Thereafter, step S326 is executed.

(Step S326)

The determining unit 320 determines the natural number "N" and the residual value "α" with the updated first dispensing amount "DDA." Thereafter, step S330 is executed.

(Another Method for Determining Fourth Dispensing Amount)

According to the method described with reference to FIGS. 4 and 5, the third dispensing amount in the second washing event is adjusted, and the detergent storing unit 220 is emptied after the completion of the second washing event. However, the second dispensing amount in the first washing event and the third dispensing amount in the second washing event may be adjusted such that the detergent storing unit 220 is emptied after the completion of the first washing event. A description will be given bellow of another method for determining the adjusted second dispensing amount (hereinafter also referred to as the fifth dispensing amount) and the adjusted third dispensing amount, that is, the fourth dispensing amount.

Figure 8:
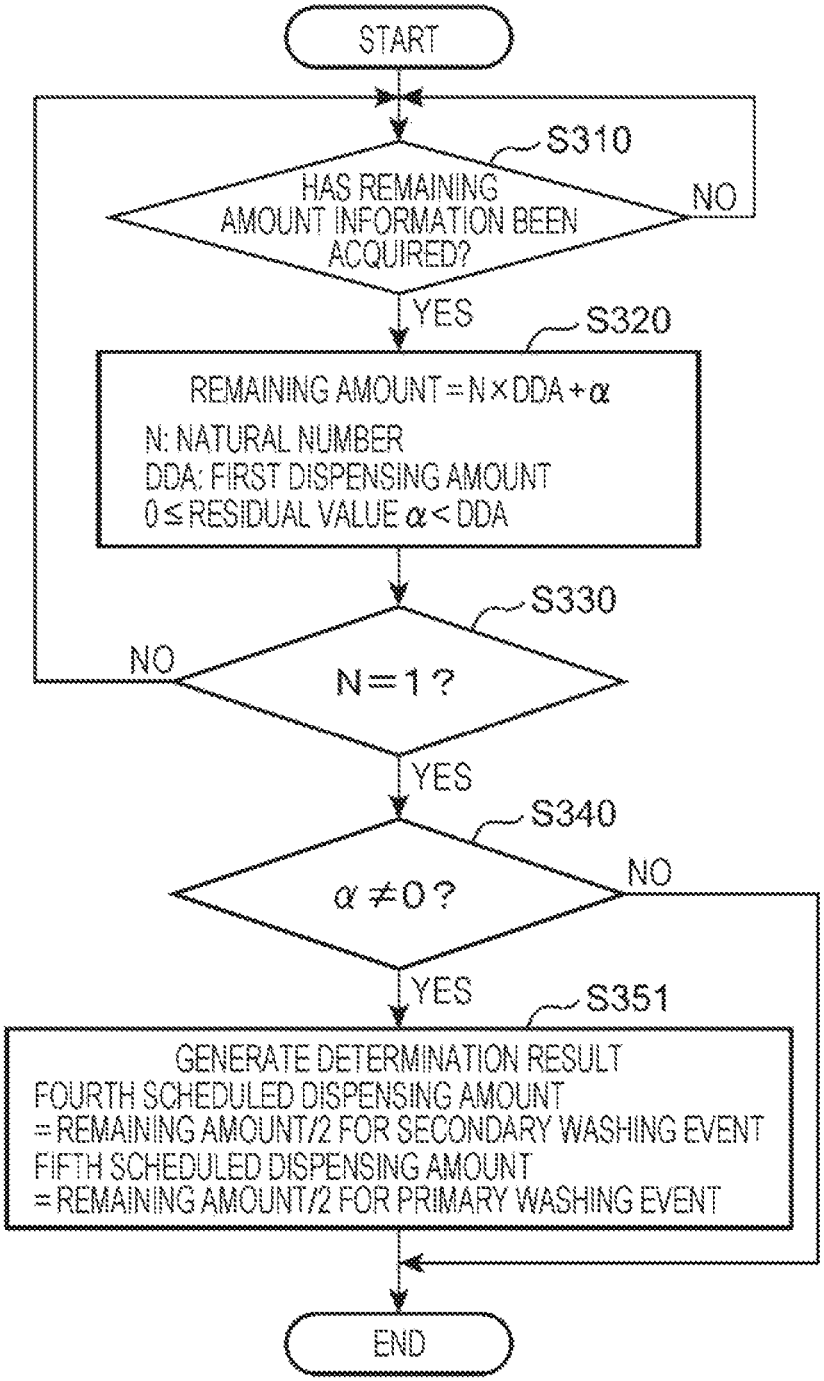
FIG. 8 is a schematic flowchart illustrating an exemplary operation of the determining unit.

FIG. 8 is a schematic flowchart illustrating an exemplary operation of the determining unit 320. The operation of the determining unit 320 will be described with reference to FIGS. 1, 4, 7, and 8.

Steps S310 to S330 described with reference to FIG. 4 are repeated until the natural number "N" equals "1." The description given with FIG. 4 will be incorporated in the description of steps S310 to S330. The process described with reference to FIG. 7 may be executed at step S320.

When the natural number "N" equals "1" at step S330, step S340 described with reference to FIG. 4 is executed. The description given with FIG. 4 will be incorporated in the description of step S340. If the residual value "α" is not "0" at step S340, step S351 is executed. Otherwise, the process is completed. Step S351 is a process replacing step S350 described with reference to FIG. 4.

Figure 9:
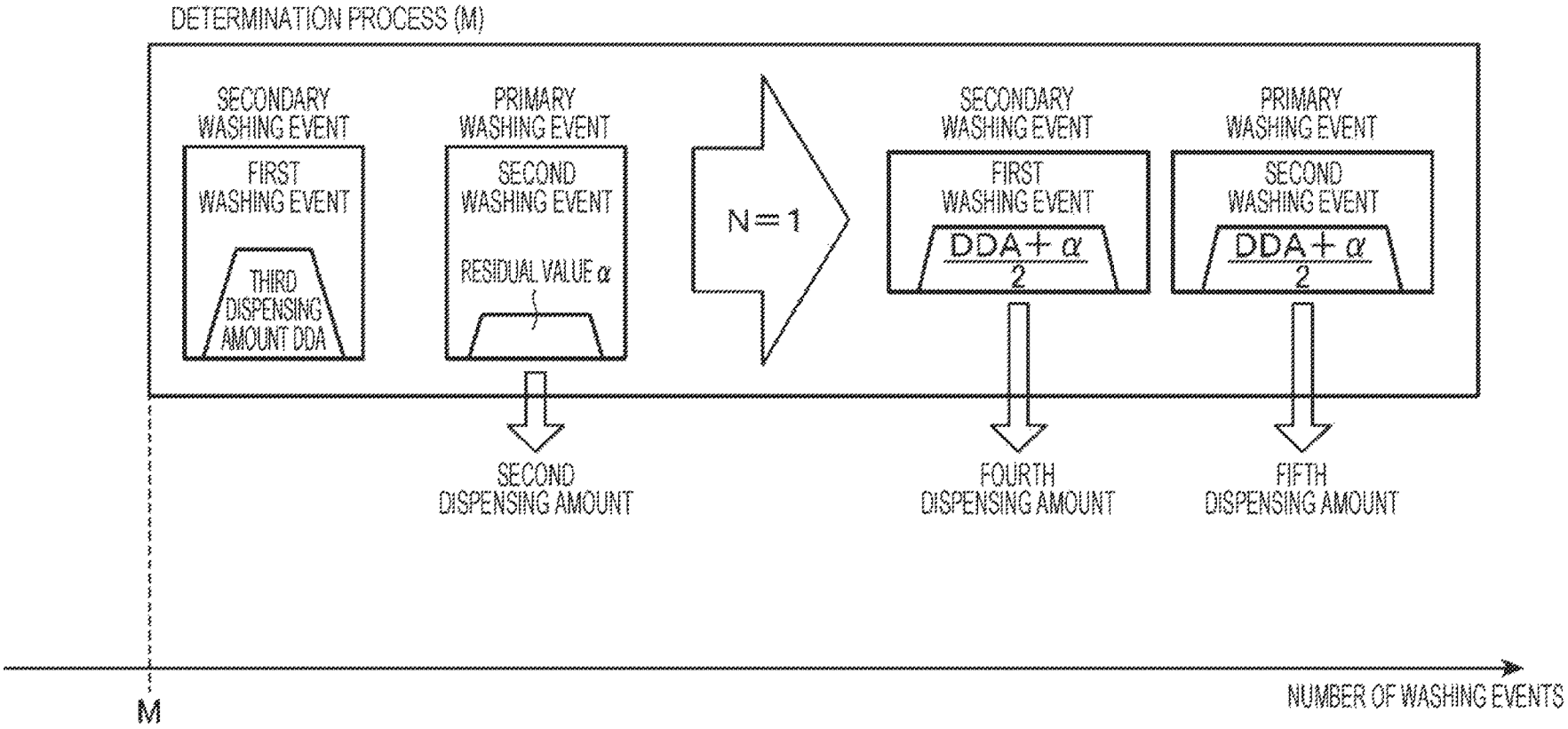
FIG. 9 is a conceptual diagram of request information generated by the process of step S351 of the operation illustrated in FIG. 8.

FIG. 9 is a conceptual diagram of request information generated by the process of step S351. The determining unit 320 and the information generating unit 330 will be described with reference to FIGS. 8 and 9.

When the natural number "N" equals "1" at step S330, the determining unit 320 determines the second washing event from the time of receipt of the immediately preceding remaining amount information as the first washing event. The determining unit 320 further determines the first washing event from the time of receipt of the immediately preceding remaining amount information as the second washing event. The determining unit 320 determines the scheduled dispensing amounts of the detergent for these washing events.

When step S351 is executed, the determining unit 320 equally divides the remaining amount represented by the remaining amount information for the first washing event and the second washing event. The determining unit 320 transmits to the information generating unit 330 an instruction to generate a dispensing request for requesting the equally divided dispensing amounts of detergent to be dispensed in the first washing event and the second washing event, respectively. The information generating unit 330 generates the dispensing request as the request information. The request information is transmitted to the dispensing control unit 231 via the information outputting unit 340 and the receiving unit 252. In accordance with the request information, the dispensing control unit 231 causes the dispensing mechanism 232 to dispense the equally divided dispensing amounts of detergent in the first washing event and the second washing event, respectively. Consequently, the detergent storing unit 220 is emptied after the first washing event. The remaining amount of the detergent is not necessarily divided equally.

In the determination process described with reference to FIGS. 8 and 9, one washing event immediately preceding the first washing event is processed as the second washing event. However, each of a plurality of washing events immediately preceding the first washing event is also processed as the second washing event. In the determination process described with reference to FIG. 8, if step S340 is executed when the natural number "N" equals "2," two washing events immediately preceding the first washing event are each processed as the second washing event. In this case, the remaining amount represented by the remaining amount information is equally divided into three amounts. The values of the three equally divided amounts are set as the fourth dispensing amounts for the two second washing events and the fifth dispensing amount for the first washing event, respectively.

Second Embodiment

As for the foregoing embodiment, for how many washing events the detergent dispensing amount is to be adjusted, that is, the number of washing events to be executed until the detergent is used up, entirely depends on the information processing apparatus 300. The number of washing events to be executed until the detergent is used up, however, may be set by the user. A washing system according to a second embodiment, therefore, allows the user to set the number of washing events to be executed until the detergent is used up. An exemplary washing system of the second embodiment will be described below.

Figure 10:
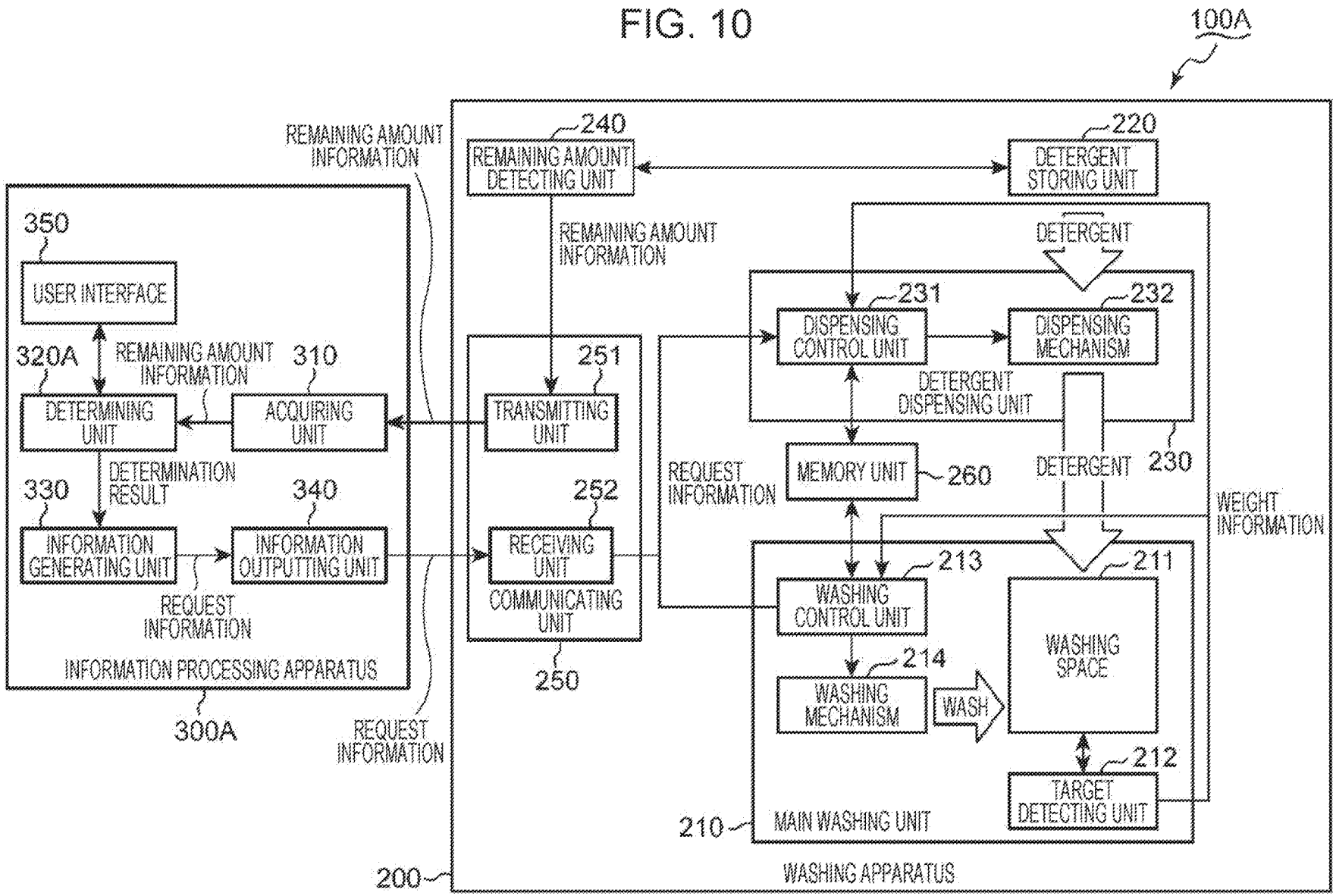
FIG. 10 is a schematic block diagram illustrating an exemplary functional configuration of a washing system of a second embodiment.

FIG. 10 is a schematic block diagram illustrating an exemplary functional configuration of a washing system 100A of the second embodiment. The washing system 100A will be described with reference to FIG. 10.

The washing system 100A includes the washing apparatus 200 similarly as in the first embodiment. The description of the first embodiment will be incorporated in the description of the washing apparatus 200.

The washing system 100A further includes an information processing apparatus 300A. The information processing apparatus 300A includes the acquiring unit 310, the information generating unit 330, and the information outputting unit 340 similarly as in the first embodiment. The description of the first embodiment will be incorporated in the description of these elements.

The washing system 100A includes a determining unit 320A and a user interface 350. The determining unit 320A finds a first washing event in which shortage of the detergent dispensing amount is expected, and determines the detergent dispensing amount for each washing event for which the detergent dispensing amount is to be adjusted. The user interface 350 is used by the user to set the number of washing events to be executed until the detergent is used up. As for the present embodiment, the user interface 350 is a common touch panel, but may be another device capable of providing information to the user and receiving input from the user. The principle of the present embodiment is not limited to a specific device used as the user interface 350.

Figure 11:
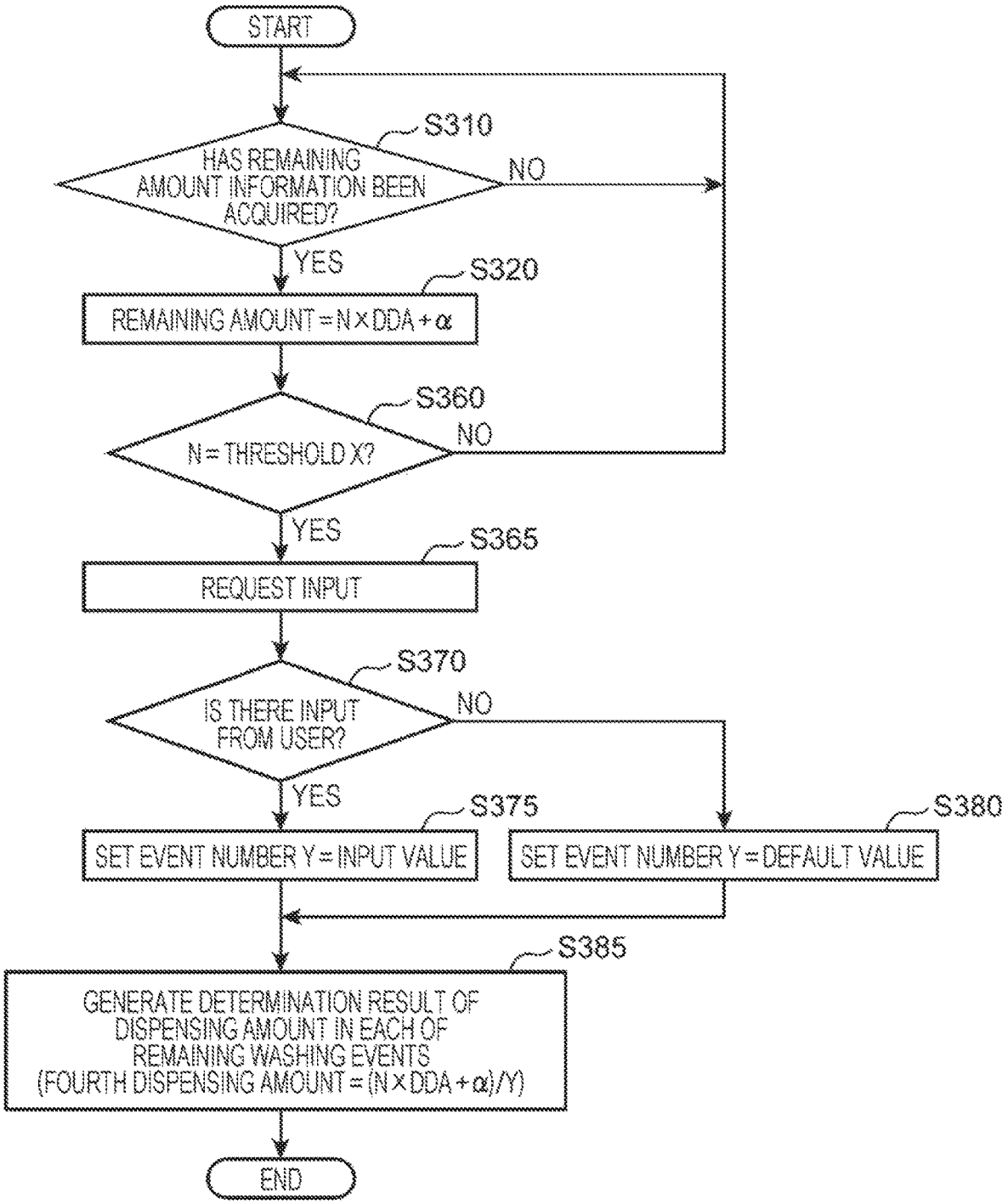
FIG. 11 is a schematic flowchart illustrating an exemplary operation of a determining unit of the washing system illustrated in FIG. 10.

FIG. 11 is a schematic flowchart illustrating an exemplary operation of the determining unit 320A. The operation of the determining unit 320A will be described with reference to FIGS. 4, 7, 8, 10, and 11. Detailed description of the already described processes will be omitted.

(Step S310)

The determining unit 320A waits for the remaining amount information.

(Step S320)

The determining unit 320A calculates the natural number "N" and the residual value "α" from the remaining amount represented by the remaining amount information and the first dispensing amount.

(Step S360)

If the natural number "N" is a threshold "X," step S365 is executed. Otherwise, the process returns to step S310. The threshold "X" is previously set.

(Step S365)

The determining unit 320A requests the user interface 350 to display an input image. The input image includes an input window for requesting the user to input the number of washing events to be executed until the detergent is used up and for allowing the user to input the number of washing events. The input image further includes an input window for the user to allow the information processing apparatus 300A to automatically determine the number of washing events to be executed until the detergent is used up.

(Step S370)

The determining unit 320A checks whether there is input from the user. If the user operates the user interface 350 in accordance with the request displayed on the input image, the input from the user is transmitted to the determining unit 320A from the user interface 350. If the determining unit 320A receives the input from the user, step S375 is executed. Otherwise, step S380 is executed.

(Step S375)

The determining unit 320A sets the number 'Y' of washing events to be executed until the detergent is used up (hereinafter referred to as the "set event number") to the value input by the user.

(Step S380)

The determining unit 320A sets the set event number 'Y' to a predetermined default value.

(Step S385)

The determining unit 320A generates a determination result representing the scheduled dispensing amount of detergent to be dispensed in each of the remaining washing events, that is, the "fourth dispensing amount." Specifically, the determining unit 320A generates a determination result including the value obtained by dividing the remaining amount of the detergent by the set event number "Y." Then, the information generating unit 330 generates, as the request information, a dispensing request for requesting the detergent to be dispensed by the amount corresponding to the value included in the determination result.

Figure 12:
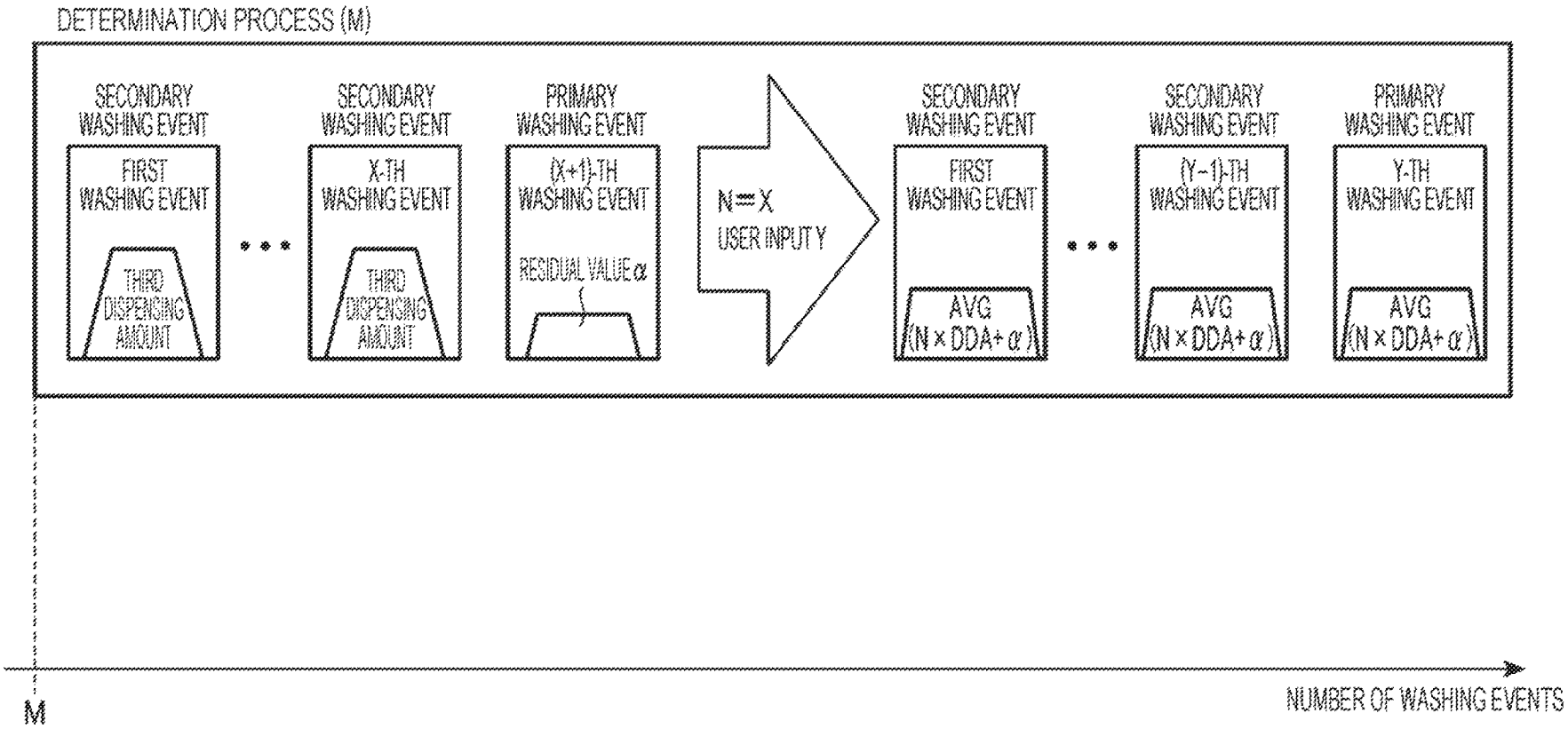
FIG. 12 is a conceptual diagram of a determination process of the determining unit in the washing system of the second embodiment.

FIG. 12 is a conceptual diagram of a determination process of the determining unit 320A. The determination process of the determining unit 320A will be described with reference to FIGS. 10 and 12.

DETERMINATION PROCESS (M) in FIG. 12 represents the process of the determining unit 320A performed when the M-th washing event arises. The determining unit 320A has determined that an amount of detergent enabling up to "X" washing events, wherein "X" represents the threshold, to be executed with the third dispensing amount, that is, the first dispensing amount "DDA," remains in the detergent storing unit 220. Since "N=X" holds (YES at step S360), the determining unit 320A requests the user to input the set event number "Y." If there is input from the user, the determining unit 320A sets the input value as the set event number "Y." The determining unit 320A then sets the amount obtained by dividing the remaining amount of the detergent by the set event number "Y" (in other words, the amount obtained by equally dividing the remaining amount by the set event number "Y") as the fourth dispensing amount. It is thereby possible to use up the detergent with "Y" washing events requested by the user.

In place of the set event number "Y," the user may input the detergent dispensing amount per washing event, and the set event number "Y" may be determined based on this dispensing amount.

Third Embodiment

According to the control principle described in relation to the foregoing embodiments, the dispensing amounts of detergent to be dispensed in a first washing event in which shortage of detergent is expected and at least one second washing event set to immediately precede the first washing event are adjusted, to thereby empty the detergent storing unit 220. Meanwhile, if a small amount of detergent remaining in the detergent storing unit 220 is alternatively evacuated into a predetermined spare storing space, the detergent storing unit 220 is similarly emptied. Therefore, a washing system according to a third embodiment empties the detergent storing unit 220 by evacuating the small amount of detergent remaining in the detergent storing unit 220 into the predetermined spare storing space. An exemplary control technique of the third embodiment will be described below.

Figure 13:
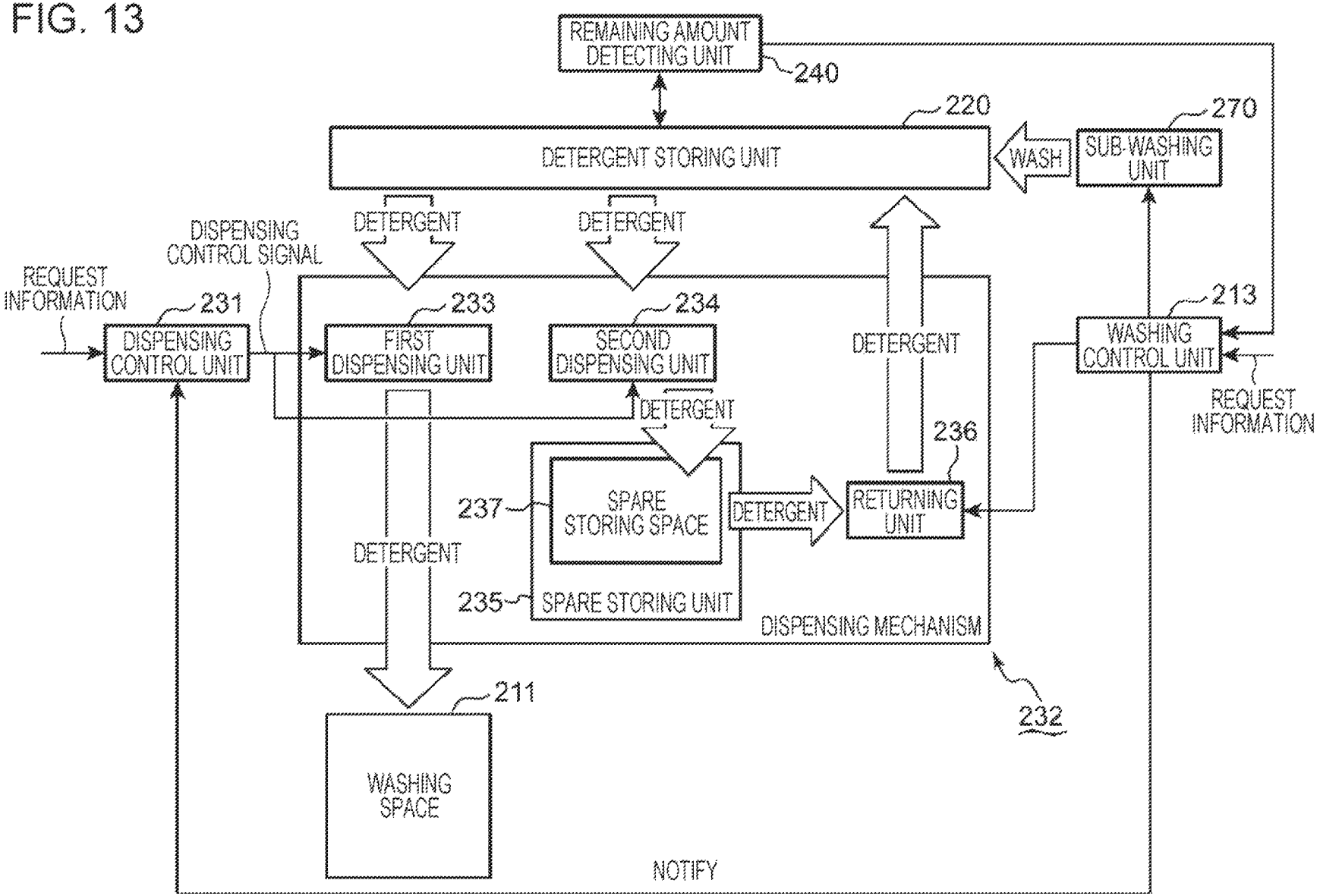
FIG. 13 is a schematic block diagram of a dispensing mechanism of the washing system illustrated in FIG. 1 (a third embodiment)

FIG. 13 is a schematic block diagram of the dispensing mechanism 232 and components relating to the dispensing mechanism 232. The dispensing mechanism 232 will be described with reference to FIGS. 1 and 13.

The dispensing mechanism 232 includes a first dispensing unit 233, a second dispensing unit 234, a spare storing unit 235, and a returning unit 236. If a sufficient amount of detergent remains in the detergent storing unit 220, the first dispensing unit 233 dispenses the detergent into the washing space 211 from the detergent storing unit 220 under the control of the dispensing control unit 231. Meanwhile, if an insufficient amount of detergent remains in the detergent storing unit 220, a detergent supply passage communicating with the first dispensing unit 233 is closed. Instead of the first dispensing unit 233, the second dispensing unit 234 operates under the control of the dispensing control unit 231 to dispense all detergent remaining in the detergent storing unit 220 into the spare storing unit 235. If the detergent is liquid or gel, the first dispensing unit 233 and the second dispensing unit 234 may be valves that operate under the control of the dispensing control unit 231. If the detergent is solid (powder), the first dispensing unit 233 and the second dispensing unit 234 may be screw feeders that operate under the control of the dispensing control unit 231. The principle of the present embodiment is not limited to a specific structure of the first dispensing unit 233 and the second dispensing unit 234.

The spare storing unit 235 is a container forming a spare storing space 237 in which the detergent is temporarily stored. The second dispensing unit 234 dispenses the detergent into the spare storing space 237 from the detergent storing unit 220. The returning unit 236 returns the detergent into the detergent storing unit 220 from the spare storing space 237. If the detergent is liquid or gel, the returning unit 236 may be a pump. If the detergent is solid (powder), the returning unit 236 may be a screw feeder. The principle of the present embodiment is not limited to a specific structure of the returning unit 236.

The washing apparatus 200 further includes a sub-washing unit 270 that washes the detergent storing unit 220. The washing control unit 213 controls the returning unit 236 and the sub-washing unit 270 as well as the washing mechanism 214. In addition, the washing control unit 213 notifies the dispensing control unit 231 of the time to dispense the detergent or the completion of the washing event.

The determining unit 320 (see FIG. 1) executes the process described with reference to FIG. 4. At step S350, however, the determining unit 320 generates a determination result, the contents of which are different from those of the first embodiment.

Figure 14:
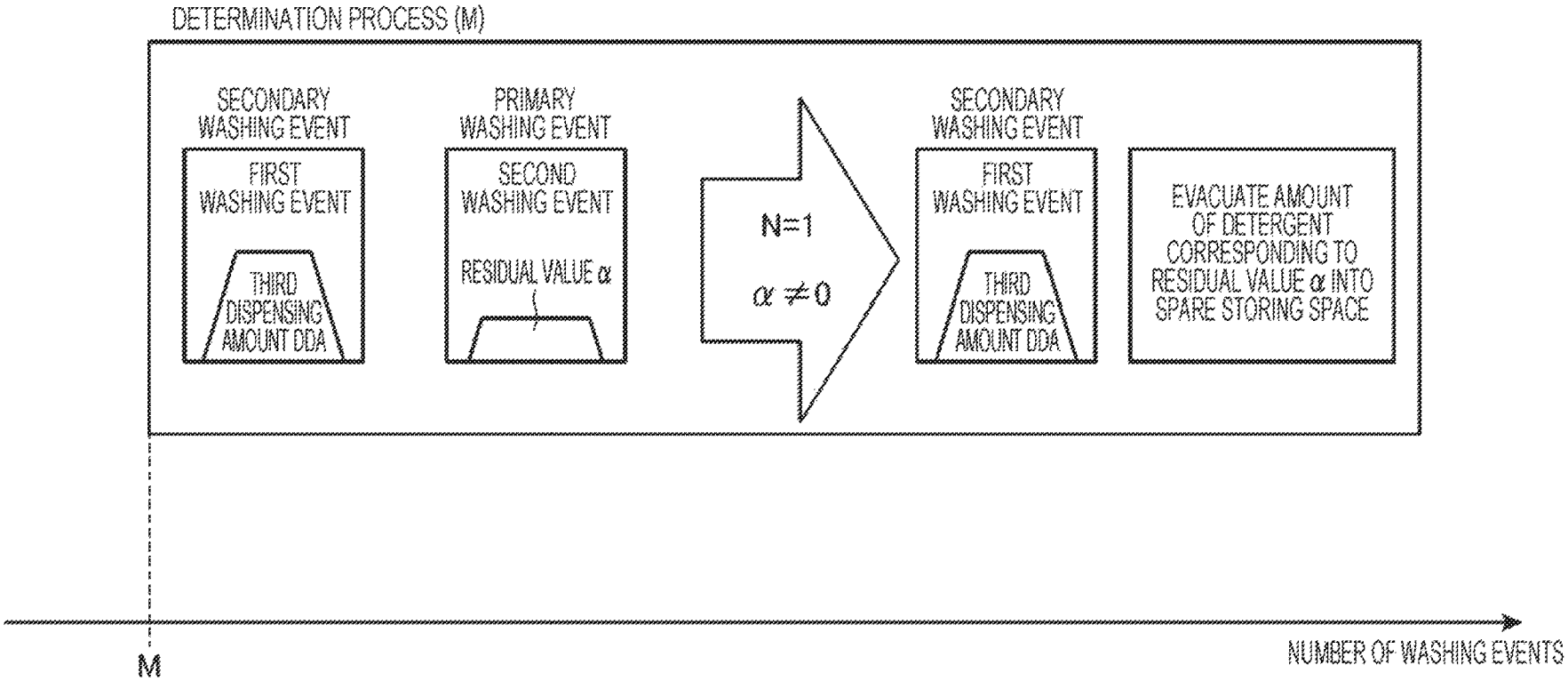
FIG. 14 is a conceptual diagram of a determination process of the determining unit.

FIG. 14 is a conceptual diagram of a determination process of the determining unit 320. The determining unit 320 will be described with reference to FIGS. 1, 4, and 14.

FIG. 14 indicates that the natural number "N" equals "1" as a result of execution of M washing events. When the natural number "N" equals "1," the second washing event from the time of receipt of the immediately preceding remaining amount information is the first washing event. The first washing event from the time of receipt of the immediately preceding remaining amount information is the second washing event. FIG. 14 indicates that it is possible to dispense the third dispensing amount of detergent in the second washing event, and that only an amount of detergent corresponding to the residual value "α" remains in the detergent storing unit 220 after the second washing event. At step S340 described with reference to FIG. 4, the determining unit 320 checks whether the residual value "α" equals "0." The result of determination of whether the residual value "α" equals "0" is transmitted to the information generating unit 330 from the determining unit 320. If the determination result indicates that the residual value "α" is not "0," the information generating unit 330 generates, as the request information, an evacuation request for requesting the detergent in the detergent storing unit 220 (that is, the amount of detergent corresponding to the residual value "α") to be temporarily evacuated into the spare storing space 237 after the completion of the second washing event. The request information is output to the dispensing control unit 231 and the washing control unit 213 via the information outputting unit 340 and the receiving unit 252.

Figure 15:
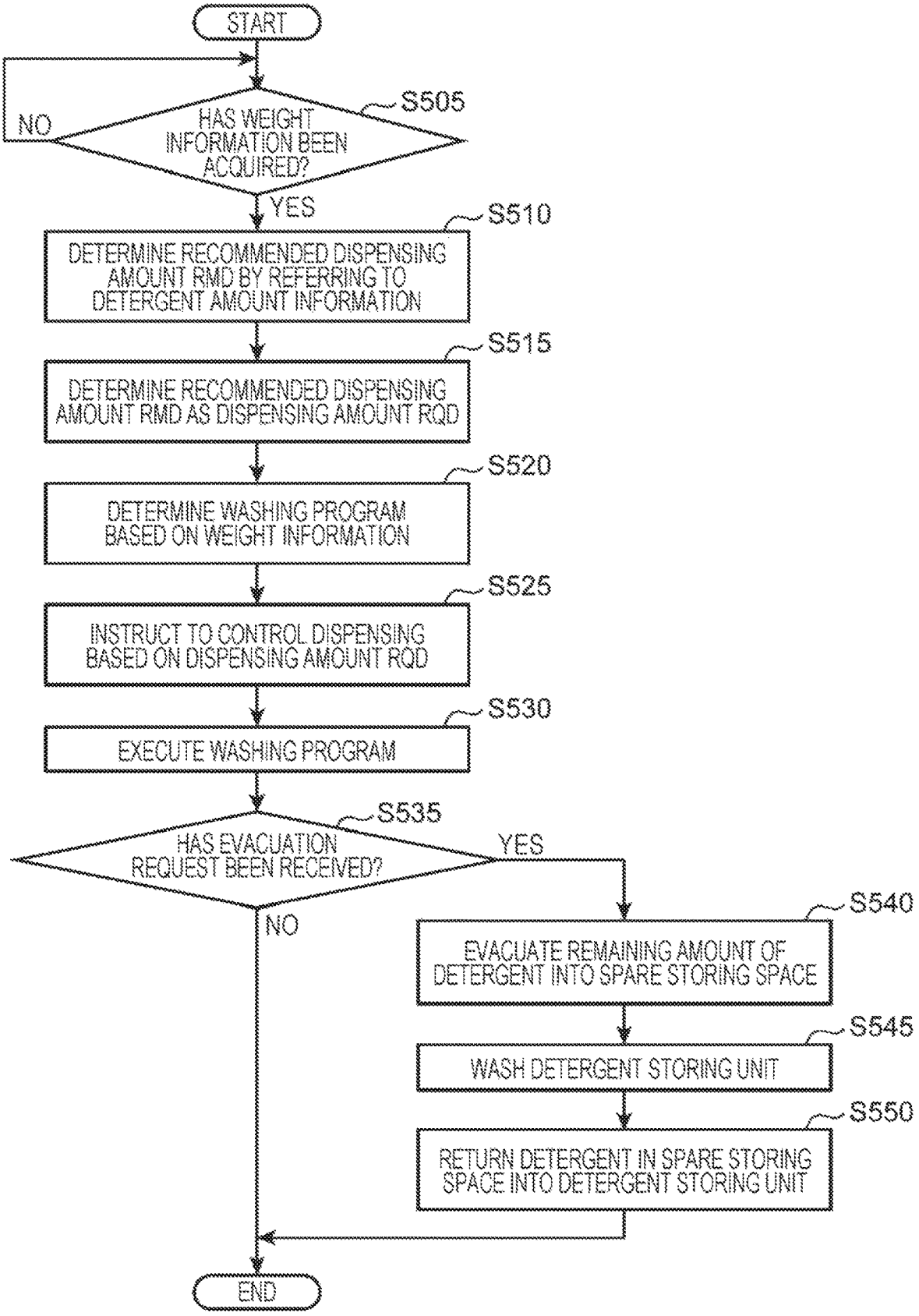
FIG. 15 is a schematic flowchart illustrating an exemplary operation of the dispensing control unit and the washing control unit.

FIG. 15 is a schematic flowchart illustrating an exemplary operation of the dispensing control unit 231 and the washing control unit 213. The operation of the dispensing control unit 231 and the washing control unit 213 will be described with reference to FIGS. 1, 13, and 15.

(Step S505)

The dispensing control unit 231 and the washing control unit 213 wait for the weight information. After the dispensing control unit 231 and the washing control unit 213 receive the weight information from the target detecting unit 212 (see FIG. 1), step S510 is executed.

(Step S510)

The dispensing control unit 231 determines the recommended dispensing amount "RMD" corresponding to the weight represented by the weight information acquired at step S505. Thereafter, step S515 is executed.

(Step S515)

The dispensing control unit 231 determines the recommended dispensing amount "RMD" determined at step S510 as the dispensing amount "RQD." Thereafter, step S520 is executed.

(Step S520)

The washing control unit 213 refers to the program list (TABLE 2) stored in the memory unit 260, and determines a washing program corresponding to the weight represented by the weight information acquired at step S505. If the weight represented by the weight information is in the range of "equal to or greater than $TW_1$ and less than $TW_2$," the washing control unit 213 determines "Program 2" as the washing program to be adjusted. After the washing program is determined, step S525 is executed.

(Step S525)

The dispensing control unit 231 generates a dispensing control signal such that the detergent is dispensed into the washing space 211 by the dispensing amount "RQD" determined at step S515. The dispensing control signal is output to the first dispensing unit 233 from the dispensing control unit 231. In accordance with the dispensing control signal, the first dispensing unit 233 dispenses the dispensing amount "RQD" of detergent into the washing space 211 from the detergent storing unit 220. After the detergent is dispensed into the washing space 211 from the detergent storing unit 220, step S530 is executed.

(Step S530)

The washing control unit 213 executes the washing program determined at step S520. Thereafter, step S535 is executed.

(Step S535)

The dispensing control unit 231 and the washing control unit 213 check whether the evacuation request has been received as the request information. If the evacuation request has been output to these units, step S540 is executed. Otherwise, the process is completed, and the next washing event is waited for.

(Step S540)

The dispensing control unit 231 generates a dispensing control signal for operating the second dispensing unit 234. The dispensing control signal is output to the second dispensing unit 234 from the dispensing control unit 231. In accordance with the dispensing control signal, the second dispensing unit 234 dispenses the detergent into the spare storing space 237 from the detergent storing unit 220. Consequently, the detergent storing unit 220 is emptied. After the generation of the dispensing control signal, step S545 is executed.

(Step S545)

The washing control unit 213 controls the sub-washing unit 270 to wash the detergent storing unit 220. Consequently, the risk of malfunction of the washing apparatus 200 attributed to solidification or increase in viscosity of the detergent in the detergent storing unit 220 is reduced. After the washing of the detergent storing unit 220 is completed, step S550 is executed.

(Step S550)

The washing control unit 213 controls the returning unit 236 to return the detergent in the spare storing space 237 into the detergent storing unit 220.

In the present embodiment, the detergent temporarily evacuated in the spare storing space 237 is returned into the detergent storing unit 220 (step S550), and thus is reusable in a subsequent washing event. It is preferable that the detergent newly dispensed into the washed detergent storing unit 220 by the user be of the same type as the type of detergent returned to the detergent storing unit 220. Therefore, information representing the type of detergent being used may be notified to the user via the washing apparatus 200 and/or the information processing apparatus 300. In this case, a management technique for managing the type of detergent being used or a notification technique for notifying the user of the type of detergent being used is incorporated in the washing apparatus 200 and/or the information processing apparatus 300.

As illustrated in FIG. 15, when the request information is output from the information processing apparatus 300 (see FIG. 1), the washing of the detergent storing unit 220 is executed. Therefore, outputting the request information to the washing control unit 213 means requesting the detergent storing unit 220 to be washed.

As for the present embodiment, the detergent storing unit 220 is automatically washed by the sub-washing unit 270. The washing system 100, however, may include a notifying device that notifies the user that the time has come to wash the detergent storing unit 220 (an image display device capable of displaying text information and/or image information (a touch panel, for example) or an audio device that outputs beep sound or audio guidance). When the detergent storing unit 220 is emptied, the notifying device may notify the user that the time has come to wash the detergent storing unit 220 under the control of the washing control unit 213.

Fourth Embodiment

As for the foregoing embodiments, the information processing apparatus 300 or 300A is disposed at a position away from the washing apparatus 200, and communicates with the washing apparatus 200. However, the information processing apparatus 300 or 300A may be incorporated in the washing apparatus 200 to function as a part of the washing apparatus 200. In a fourth embodiment, an exemplary washing apparatus having an information processing apparatus incorporated therein will be described.

Figure 16:
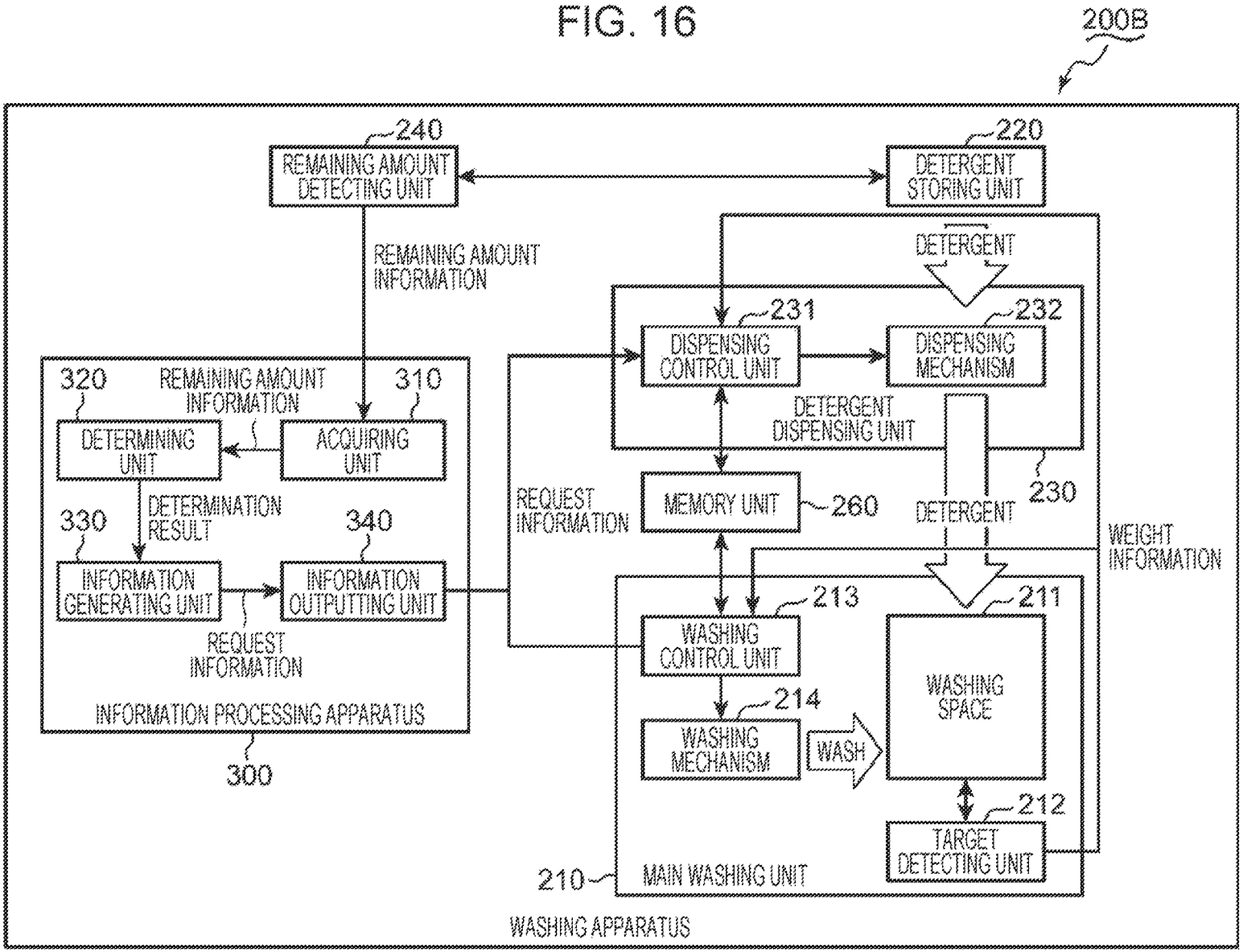
FIG. 16 is a schematic block diagram illustrating an exemplary functional configuration of a washing apparatus of a fourth embodiment.

FIG. 16 is a schematic block diagram illustrating an exemplary functional configuration of a washing apparatus 200B of the fourth embodiment. The washing apparatus 200B will be described with reference to FIG. 16.

The washing apparatus 200B includes the main washing unit 210, the detergent storing unit 220, the detergent dispensing unit 230, the remaining amount detecting unit 240, and the memory unit 260 similarly as in the first embodiment. The description of the first embodiment will be incorporated in the description of these elements.

The information processing apparatus 300 described in relation to the first embodiment is incorporated in the washing apparatus 200B. The description of the first embodiment will be incorporated in the description of the information processing apparatus 300.

The information processing apparatus 300 may be designed as a control circuit that controls the washing apparatus 200B. In this case, the control circuit may have the functions of the information processing apparatus 300, the washing control unit 213, and the dispensing control unit 231.

The acquiring unit 310 directly receives the remaining amount information from the remaining amount detecting unit 240. The determining unit 320 and the information generating unit 330 execute the information processing described in relation to the first embodiment to generate the request information. The request information is transmitted to the information outputting unit 340 from the information generating unit 330. The information outputting unit 340 directly transmits the request information to the dispensing control unit 231 and the washing control unit 213.

As for the foregoing embodiments, the detergent dispensing amount is determined, before the generation of the request information, based on the weight of the washing target placed in the washing space 211 (see "TABLE 1"). The detergent dispensing amount, however, may be determined based on the water supply amount determined in accordance with the weight of the washing target. In this case, the detergent dispensing amount is associated with the weight of the washing target via the water supply amount.

As described above, according to the embodiments of the present disclosure, an information processing method is provided which is performed with a processor and includes: acquiring, from a washing apparatus, remaining amount information representing a remaining amount of detergent in a detergent container included in the washing apparatus to store the detergent; determining whether a second dispensing amount of the detergent falls below a predetermined threshold based on the remaining amount information and a first dispensing amount, the first dispensing amount being set for one washing event in which the washing apparatus washes a washing target, and the second dispensing amount being an amount of the detergent scheduled to be dispensed into the washing apparatus in a scheduled first washing event; changing a third dispensing amount to a fourth dispensing amount when the second dispensing amount is determined to fall below the predetermined threshold, the third dispensing amount being an amount of the detergent determined based on the first dispensing amount and scheduled to be dispensed into the washing apparatus in at least one second washing event scheduled to precede the first washing event, and the fourth dispensing amount being equal to or greater than the predetermined threshold; and outputting information representing the fourth dispensing amount to the washing apparatus to dispense the fourth dispensing amount of the detergent into the washing apparatus in the at least one second washing event.

According to existing techniques, the remaining amount of the detergent falls below the predetermined threshold in some washing events. According to the above-described configuration, the dispensing amount of the detergent in the at least one second washing event executed before the first washing event is changed. Therefore, the detergent is used up before the first washing event, or the amount of the detergent to be dispensed in the first washing event exceeds the predetermined threshold. Accordingly, it is possible to empty the detergent container while dispensing the detergent by an amount desirable for washing. That is, the above-described configuration is capable of finding a time suitable for washing the detergent container. Consequently, the washing of the detergent container is prompted, thereby reducing the risk of malfunction of the washing apparatus.

Further, the changing the third dispensing amount may include determining the fourth dispensing amount to empty the detergent container after completion of the at least one second washing event.

According to the above-described configuration, the detergent container is emptied with the detergent therein used up after the completion of the second washing event, that is, before the scheduled first washing event. It is therefore possible to advance the time for washing the detergent container, and thus to further reduce the risk of malfunction of the washing apparatus.

Further, the fourth dispensing amount may be greater than the first dispensing amount.

According to the above-described configuration, it is possible to dispense, in the second washing event preceding the first washing event, the detergent supposed to have been dispensed in the scheduled first washing event.

Further, the changing the third dispensing amount may include determining the fourth dispensing amount of the detergent scheduled to be dispensed in the at least one second washing event to make a dispensing amount of the detergent in the first washing event equal to or greater than the predetermined threshold and empty the detergent container after completion of the first washing event.

According to the above-described configuration, the detergent container is emptied with the detergent therein used up after the completion of the scheduled first washing event. It is possible to execute the scheduled number of washing events while creating an opportunity to wash the detergent container.

Further, the changing the third dispensing amount may include dividing the remaining amount of the detergent represented by the remaining amount information into predetermined amounts for the first washing event and the at least one second washing event, wherein each of the predetermined amounts is equal to or greater than the predetermined threshold.

According to the above-described configuration, the dispensing amount of the detergent to be dispensed in the first washing event and the at least one second washing event is divided into the predetermined amounts each equal to or greater than the threshold. It is therefore possible to suppress excess or deficiency of the amount of the detergent to be dispensed. Accordingly, it is possible to appropriately wash the washing target while changing the dispensing amount of the detergent. The third dispensing amount may be equally divided for the respective events.

Further, the changing the third dispensing amount may include (i) inquiring of a user a number of at least one washing event set as the at least one second washing event, (ii) receiving the number of the at least one washing event from the user, and (iii) calculating the fourth dispensing amount of the detergent to be dispensed in the at least one second washing event based on the remaining amount information before start of the at least one second washing event and the number received from the user.

According to the above-described configuration, the number of the at least one washing event set as the at least one second washing event is inquired of the user. It is therefore possible to determine an amount suiting the request or habit of the user as the third dispensing amount.

Further, the fourth dispensing amount may be less than the first dispensing amount.

According to the above-described configuration, it is possible to compensate for the shortage in the amount of detergent in the first washing event with the detergent scheduled to have been dispensed in the second washing event.

Further, the information processing method may further include determining to cause the washing apparatus to execute an evacuation operation of evacuating the detergent remaining in the detergent container into a predetermined spare storing space after completion of the at least one second washing event, and requesting the washing apparatus to execute the evacuation operation after the completion of the at least one second washing event.

According to the above-described configuration, with an amount of the detergent less than the predetermined threshold being evacuated, it is possible to create an opportunity to wash the detergent container without changing the amount of the detergent to be dispensed in the second washing event.

Further, the information processing method may further include determining to cause the washing apparatus to execute a tertiary washing event without the washing target and with the detergent remaining in the detergent container after completion of the at least one second washing event, and causing the washing apparatus to execute the tertiary washing event after the completion of the at least one second washing event.

According to the above-described configuration, the amount of detergent less than the predetermined threshold is consumed independently of the washing events. It is thereby possible to create an opportunity to wash the detergent container without changing the amount of the detergent to be dispensed in the second washing event.

Further, the information processing method may further include outputting a washing request for requesting the detergent container to be washed after completion of the first washing event or the at least one second washing event.

According to the above-described configuration, the washing request for requesting the detergent container to be washed is output to the washing apparatus, thereby making it possible to wash the detergent container more reliably. Consequently, it is possible to reduce the risk of solidification or excessive increase in viscosity of the detergent. Accordingly, it is possible to reduce the risk of a failure in which the detergent solidified or increased in viscosity clogs a passage in the washing apparatus.

Further, an information processing apparatus according to another aspect of the present disclosure includes an acquirer, a determiner, an information generator, and an information outputter. The acquirer acquires, from a washing apparatus, remaining amount information representing a remaining amount of detergent in a detergent container included in the washing apparatus to store the detergent. The determiner determines whether a second dispensing amount of the detergent falls below a predetermined threshold based on the remaining amount information and a first dispensing amount. The first dispensing amount is set for one washing event in which the washing apparatus washes a washing target. The second dispensing amount is an amount of the detergent scheduled to be dispensed into the washing apparatus in a scheduled first washing event. The information generator changes a third dispensing amount to a fourth dispensing amount when the second dispensing amount is determined to fall below the predetermined threshold. The third dispensing amount is an amount of the detergent determined based on the first dispensing amount and scheduled to be dispensed into the washing apparatus in at least one second washing event scheduled to precede the first washing event. The fourth dispensing amount is equal to or greater than the predetermined threshold. The information outputter outputs information representing the fourth dispensing amount to the washing apparatus to dispense the fourth dispensing amount of the detergent into the washing apparatus in the at least one second washing event.

Further, a washing system according to another aspect of the present disclosure includes the above-described information processing apparatus and the washing apparatus in which the washing target is placed. The washing apparatus includes (i) the detergent container, (ii) a detergent dispenser that dispenses the detergent from the detergent container into a washing space in which the washing target is washed, (iii) a remaining amount detector that detects the remaining amount of the detergent in the detergent container and generates the remaining amount information representing the remaining amount, and (iv) a communicator that transmits the remaining amount information to the information processing apparatus and receives the information representing the fourth dispensing amount. The detergent dispenser dispenses the fourth dispensing amount of the detergent into the washing space in the at least one second washing event in accordance with the information representing the fourth dispensing amount.

Further, a washing apparatus according to another aspect of the present disclosure includes the detergent container, a detergent dispenser that dispenses the detergent from the detergent container into a washing space in which the washing target is washed, and a remaining amount detector that detects the remaining amount of the detergent in the detergent container and generates the remaining amount information representing the remaining amount. The detergent dispenser dispenses the fourth dispensing amount of the detergent into the washing space in the at least one second washing event in accordance with the information representing the fourth dispensing amount.

The information processing apparatus, the washing system, or the washing apparatus described above changes the dispensing amount of the detergent in the at least one second washing event executed before the first washing event. Therefore, the detergent is used up before the first washing event, or the amount of the detergent dispensed in the first washing event exceeds the predetermined threshold. Accordingly, it is possible to empty the detergent container while dispensing the detergent by the amount desirable for washing. That is, it is possible to find a time suitable for washing the detergent container. Consequently, the washing of the detergent container is prompted, thereby reducing the risk of malfunction of the washing apparatus.

Further, the washing apparatus may include a target detector that detects a weight of the washing target. The first dispensing amount and the third dispensing amount may be set in accordance with the weight of the washing target. The detergent dispenser may dispense the first dispensing amount or the third dispensing amount of the detergent corresponding to the weight of the washing target or the fourth dispensing amount of the detergent into the washing space before start of the at least one second washing event.

According to the above-described configuration, it is possible to suppress excess or deficiency in the amount of the detergent for the weight of the washing target. Accordingly, it is possible to appropriately wash the washing target.

Further, the washing apparatus may include a washing controller that controls washing of the washing target based on at least one of a water amount set in accordance with the weight of the washing target detected by the target detector and a washing operation. The washing controller may change at least one of the water amount and the washing operation in accordance with the information representing the fourth dispensing amount.

According to the above-described configuration, it is possible to change at least one of the amount of water to be used for washing and the washing operation (rinsing or spinning, for example) in accordance with the change in the amount of the detergent to be dispensed. Accordingly, it is possible to appropriately wash the washing target even if the amount of the detergent to be dispensed is changed.

As for the above-described configuration, the detergent dispenser may include (i) a spare container that forms a spare storing space in which the detergent is temporarily stored, (ii) a first dispenser that dispenses into the washing space the first dispensing amount or the third dispensing amount of the detergent corresponding to the weight of the washing target before the start of the at least one second washing event, (iii) a second dispenser that dispenses the detergent into the spare storing space from the detergent container, and (iv) a returner that returns the detergent in the spare storing space into the detergent container from the spare container. The information generator may generate an evacuation request for requesting the detergent remaining in the detergent container to be evacuated into the spare container after completion of the at least one second washing event. The second dispenser may evacuate the detergent into the spare container from the detergent container after the completion of the at least one second washing event in accordance with the evacuation request.

According to the above-described configuration, the amount of detergent less than the predetermined threshold is evacuated, thereby making it possible to create an opportunity to wash the detergent container without changing the amount of the detergent to be dispensed in the second washing event. Further, the detergent evacuated in the spare container is returned into the detergent container, thereby enabling efficient use of the detergent.

FIELD OF INDUSTRIAL APPLICATION

The principle of the present embodiments is preferably used in a variety of apparatuses that wash a washing target.

What is claimed is:

1. An information processing method performed with a processor, the information processing method comprising:

acquiring from an optical sensor or a weight sensor, from a washing apparatus, remaining amount information representing a remaining amount of detergent in a detergent container included in the washing apparatus to store the detergent;

determining whether a second dispensing amount of the detergent falls below a predetermined threshold based on the remaining amount information and a first dispensing amount, the first dispensing amount being set for one washing event in which the washing apparatus washes a washing target, and the second dispensing amount being an amount of the detergent scheduled to be dispensed into the washing apparatus in a scheduled first type of washing event;

changing a third dispensing amount to a fourth dispensing amount when the second dispensing amount is determined to fall below the predetermined threshold, the third dispensing amount being an amount of the detergent determined based on the first dispensing amount and scheduled to be dispensed into the washing apparatus in a plurality of second type of washing events, each of the plurality of second type of washing events being scheduled to precede the first type of washing event, and the fourth dispensing amount being equal to or greater than the predetermined threshold;

outputting information representing the fourth dispensing amount from a transmitter to the washing apparatus; and causing with a dispensing mechanism, the washing apparatus to dispense the fourth dispensing amount of the detergent in the plurality of second type of washing events.

2. The information processing method according to claim 1, wherein the changing the third dispensing amount includes determining the fourth dispensing amount to empty the detergent container after completion of the plurality of second type of washing events.

3. The information processing method according to claim 2, wherein the fourth dispensing amount is greater than the first dispensing amount.

4. The information processing method according to claim 1, wherein the changing the third dispensing amount includes determining the fourth dispensing amount of the detergent scheduled to be dispensed in the plurality of second type of washing events to make a dispensing amount of the detergent in the first type of washing event equal to or greater than the predetermined threshold and empty the detergent container after completion of the first type of washing event.

5. The information processing method according to claim 4, wherein the changing the third dispensing amount includes dividing the remaining amount of the detergent represented by the remaining amount information into predetermined amounts for the first type of washing event and the plurality of second type of washing events, each of the predetermined amounts being equal to or greater than the predetermined threshold.

6. The information processing method according to claim 5, wherein the changing the third dispensing amount includes (i) inquiring of a user a number of at least two washing events set as the plurality of second type of washing events, (ii) receiving the number of the at least two washing events from the user, and (iii) calculating the fourth dispensing amount of the detergent to be dispensed in the plurality of second type of washing events based on the remaining amount information before start of the plurality of second type of washing events and the number received from the user.

7. The information processing method according to claim 4, wherein the fourth dispensing amount is less than the first dispensing amount.

8. The information processing method according to claim 1, further comprising:

determining to cause the washing apparatus to execute an evacuation operation of evacuating the detergent remaining in the detergent container into a predetermined spare storing space after completion of the plurality of second type of washing events; and requesting the washing apparatus to execute the evacuation operation after the completion of the plurality of second type of washing events.

9. The information processing method according to claim 1, further comprising:

determining to cause the washing apparatus to execute a third type of washing event without the washing target and with the detergent remaining in the detergent container after completion of the plurality of second type of washing events; and causing the washing apparatus to execute the third type of washing event after the completion of the plurality of second type of washing events.

10. The information processing method according to claim 1, further comprising:

outputting a washing request for requesting the detergent container to be washed after completion of the first type of washing event or the plurality of second type of washing events.

* * * * *